US005717437A

United States Patent [19]

Sano et al.

[11] Patent Number: 5,717,437

[45] Date of Patent: Feb. 10, 1998

[54] MATRIX DISPLAY PANEL DRIVER WITH CHARGE COLLECTION CIRCUIT USED TO COLLECT CHARGE FROM THE CAPACITIVE LOADS OF THE DISPLAY

[75] Inventors: Yoshio Sano; Masataka Oba, both of Tokyo, Japan

[73] Assignee: NEC Corporation, Tokyo, Japan

[21] Appl. No.: 568,936

[22] Filed: Dec. 7, 1995

[30] Foreign Application Priority Data

Dec. 7, 1994 [JP] Japan ..... 6-330312

[51] Int. Cl.[6] ..... G09G 5/00

[52] U.S. Cl. ..... 345/211; 345/204

[58] Field of Search ..... 345/60, 76, 66, 345/69, 204, 211, 55; 315/169.3, 169.4

[56] References Cited

U.S. PATENT DOCUMENTS

| | | | |
|---|---|---|---|
| 4,070,663 | 1/1978 | Kanatani et al. | 345/211 |
| 4,707,692 | 11/1987 | Higgins et al. | 345/204 |
| 4,864,182 | 9/1989 | Fujioka et al. | 345/211 |
| 4,866,349 | 9/1989 | Weber et al. | 315/169.4 |
| 5,126,727 | 6/1992 | Asars | 345/211 |
| 5,227,696 | 7/1993 | Asars | 315/169.3 |
| 5,438,290 | 8/1995 | Tanaka | 315/169.4 |
| 5,528,256 | 6/1996 | Erhart et al. | 345/211 |
| 5,535,085 | 7/1996 | Tanaka et al. | 361/58 |
| 5,559,402 | 9/1996 | Corrigan, III | 345/211 |
| 5,583,527 | 12/1996 | Fujisaki et al. | 345/211 |

FOREIGN PATENT DOCUMENTS

| | | |
|---|---|---|
| 5630730 | 7/1991 | Japan . |
| 581912 | 11/1993 | Japan . |

*Primary Examiner*—Richard Hjerpe
*Assistant Examiner*—Paul A. Bell
*Attorney, Agent, or Firm*—Helfgott & Karas, P.C.

[57] ABSTRACT

A driver circuit applies data pulses to column electrodes of a display panel. The display panel includes a plurality of row electrodes formed in a plane in parallel to each other and a plurality of column electrodes formed to be isolated from the row electrodes, parallel to each other, and orthogonal to the row electrodes. To collect charge, a circuit to drive column electrodes is connected to charge collecting coils and capacitors. There is further employed an output circuit of an IC having a switch dedicated for charge collection.

10 Claims, 14 Drawing Sheets

PRIOR ART

FIG.6(A) WAVEFORM OF VOLTAGE AT P3
FIG.6(B) WAVEFORM OF OUTPUT VOLTAGE OF 2
FIG.6(C) WAVEFORM OF OUTPUT VOLTAGE OF 3
FIG.6(D) WAVEFORM OF CURRENT i1
FIG.6(E) ACTION OF FET Q1
FIG.6(F) ACTION OF FET Q2
FIG.6(G) ACTION OF FET QP1
FIG.6(H) ACTION OF FET QN1
FIG.6(I) WAVEFORM OF VOLTAGE AT PZ1
Vd
0
t1
T1
T2
T3
OFF
ON
TIME

T11 T12 T13 T14
Vd
0
OFF
ON
ON
OFF
OFF
ON
OFF
ON
ON
OFF
Vd
0
TIME
FIG.8(A) WAVEFORM OF VOLTAGE AT P13
FIG.8(B) ACTION OF FET Q11
FIG.8(C) ACTION OF FET Q12
FIG.8(D) ACTION OF FET Q13
FIG.8(E) ACTION OF FET QP11
FIG.8(F) ACTION OF FET QN11
FIG.8(G) WAVEFORM OF VOLTAGE AT PZ11

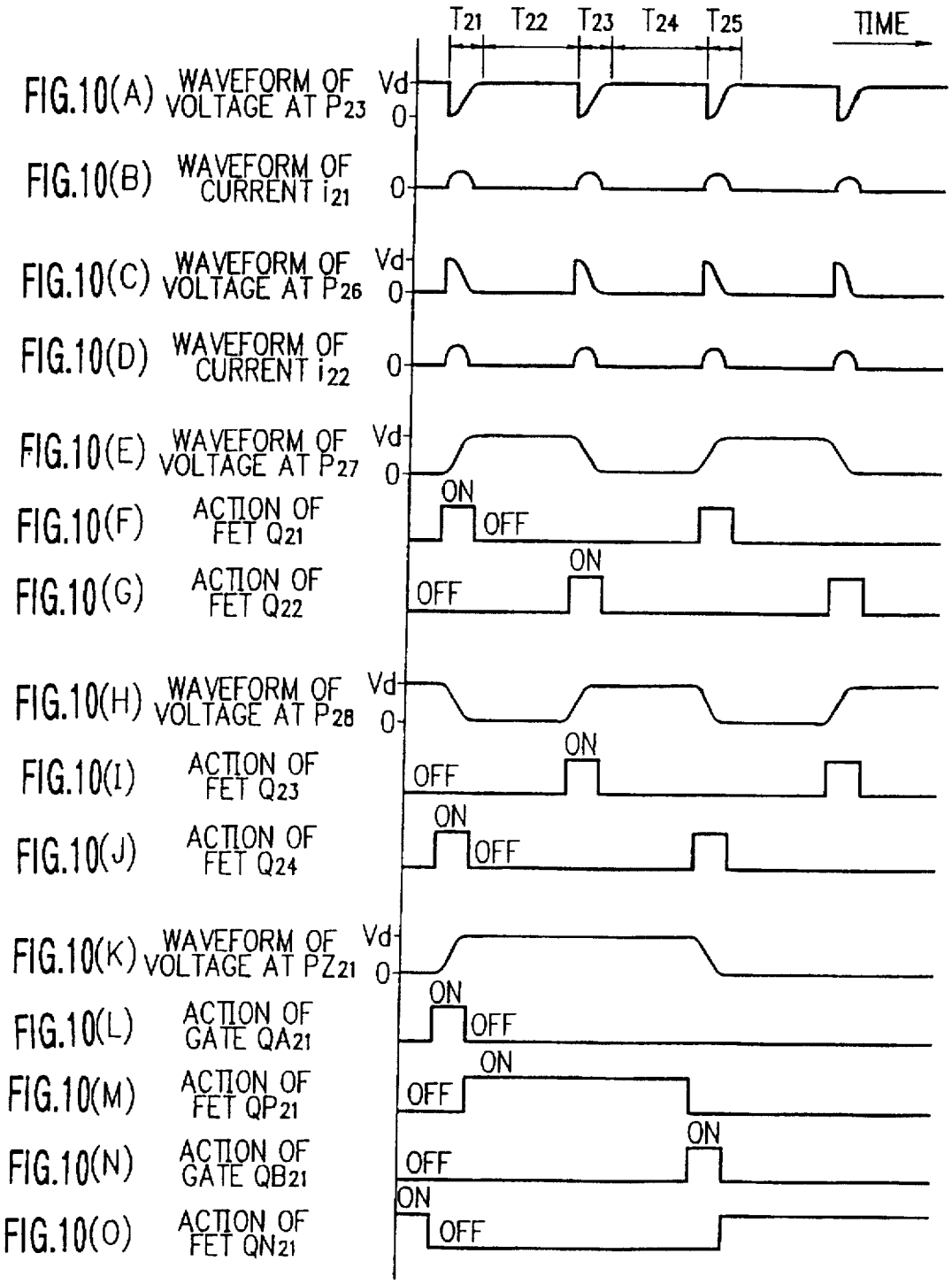
T21
T22
T23
T24
T25
TIME
FIG.10(A) WAVEFORM OF VOLTAGE AT P23
Vd
0
FIG.10(B) WAVEFORM OF CURRENT i21
0
FIG.10(C) WAVEFORM OF VOLTAGE AT P26
Vd
0
FIG.10(D) WAVEFORM OF CURRENT i22
0
FIG.10(E) WAVEFORM OF VOLTAGE AT P27
Vd
0
FIG.10(F) ACTION OF FET Q21
ON
OFF
FIG.10(G) ACTION OF FET Q22
OFF
ON
FIG.10(H) WAVEFORM OF VOLTAGE AT P28
Vd
0
FIG.10(I) ACTION OF FET Q23
OFF
ON
FIG.10(J) ACTION OF FET Q24
ON
OFF
FIG.10(K) WAVEFORM OF VOLTAGE AT PZ21
Vd
0
FIG.10(L) ACTION OF GATE QA21
ON
OFF
FIG.10(M) ACTION OF FET QP21
OFF
ON
FIG.10(N) ACTION OF GATE QB21
OFF
ON
FIG.10(O) ACTION OF FET QN21
ON
OFF

FIG.12(A) WAVEFORM OF VOLTAGE AT $P_{33}$

FIG.12(B) WAVEFORM OF CURRENT $i_{31}$

FIG.12(C) ACTION OF FET $QP_{31}$

FIG.12(D) ACTION OF GATE $QA_{31}$

FIG.12(E) ACTION OF FET $QN_{31}$

FIG.12(G) WAVEFORM OF VOLTAGE AT $PZ_{31}$

FIG.12(H) ACTION OF FET $Q_{31}$

FIG.12(I) ACTION OF FET $Q_{32}$

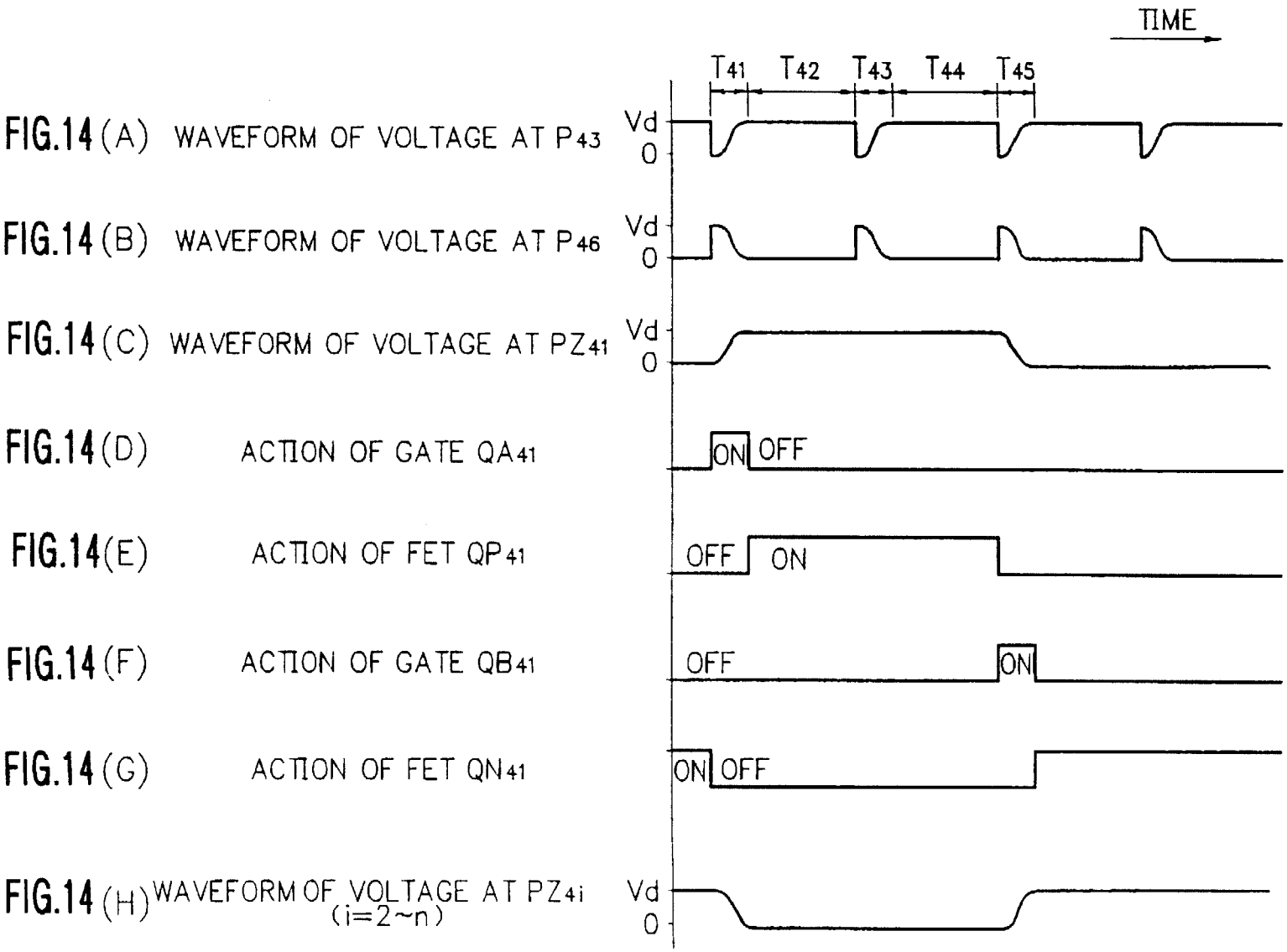
FIG.14(A) WAVEFORM OF VOLTAGE AT $P_{43}$
FIG.14(B) WAVEFORM OF VOLTAGE AT $P_{46}$
FIG.14(C) WAVEFORM OF VOLTAGE AT $PZ_{41}$
FIG.14(D) ACTION OF GATE $QA_{41}$
FIG.14(E) ACTION OF FET $QP_{41}$
FIG.14(F) ACTION OF GATE $QB_{41}$
FIG.14(G) ACTION OF FET $QN_{41}$
FIG.14(H) WAVEFORM OF VOLTAGE AT $PZ_{4i}$ $(i=2\sim n)$

MATRIX DISPLAY PANEL DRIVER WITH CHARGE COLLECTION CIRCUIT USED TO COLLECT CHARGE FROM THE CAPACITIVE LOADS OF THE DISPLAY

BACKGROUND OF THE INVENTION

The present invention relates to a driving circuit for use with a display panel of a capacitive load, namely, a flat display panel such as a plasma display panel, an electroluminescent panel, or a liquid crystal panel to be employed in an image display of an information terminal facility, a personal computer, or a television receiver and, in particular, to a charge collection circuit for efficiently decreasing power of data pulses applied to capacitive column electrodes.

DESCRIPTION OF THE RELATED ARTS

The conventional flat panels include, for example, a plasma display panel, an electroluminescent panel, and a liquid crystal panel. In the following paragraphs, description will be given of a plasma display by way of example.

FIG. 1 shows a cross-sectional construction of a plasma display panel including a first insulator substrate 11 made of glass, a second insulator substrate 12 similarly made of glass, a column electrode 13 which is a metallic electrode, an insulator layer 14 covering the column electrode, an isolating wall 15 made of an insulating material such as glass, a fluorescent layer 16, a scan electrode 17 which is a transparent electrode, e.g., a nesa electrode, a sustaining electrode 18 such as a transparent electrode, e.g., a nesa electrode, a bus electrode 19 disposed to lower resistance of the scan and sustaining electrodes 17 and 18, a thick insulator layer 20, an isolating wall 21 made of an isolating substance, a protecting layer 22 made of MgO or the like to protect the insulating layer 20 from influence of gas discharge, and a discharge gas space 23 to be filled with a discharge gas such as a rare gas to excite phosphor by gas discharge. In this configuration, an image is displayed suitably in a direction denoted by an arrow in FIG. 1.

Subsequently, referring to FIG. 2 showing the plasma display panel centered on electrodes thereof, the circuit system includes a plasma display panel 25, a sealing section 26 to hermetically sealing a space between the first and second insulating substrates 11 and 12 which are fixedly attached onto each other, the space being filled with a discharge gas; $S_1$, $S_2$, . . . , $S_m$ are scan electrodes; $Ca_1$, $Ca_2$, . . . , $Ca_m$ stand for sustaining electrodes, and $Da_1$, $Da_2$, . . . , $Da_{n-1}$, $Da_n$ are column electrodes. Assume that a cell 24 at a crosspoint of an i-th scan electrode and a j-th column electrode is represented as $a_{ij}$. In this connection, FIG. 1 shows a cross-sectional view of FIG. 2 along the column electrodes 13.

FIG. 3 is a graph showing example of driving voltage waveforms and emitted light waveforms of the plasma display panel shown in FIGS. 1 and 2.

In FIG. 3, waveform (A) is a waveform of voltage applied to sustaining electrodes 13 ($Ca_1$, $Ca_2$, . . . , $Ca_m$), waveforms (B), (C), and (D) are those of voltages respectively applied to scan electrodes $S_1$, $S_2$, and $S_m$, waveforms (E) and (F) are those of voltages respectively applied to column electrodes $Da_1$ and $Da_2$, and waveform (G) is a waveform of light emission of display cell $a_{11}$. Of the waveform (E) and (F), those slanted designate that presence or absence of pulses has been decided according to presence or absence of data to be written in the related cell. Next, operation of the configuration will be briefly described.

First, clear pulse 35 is applied to the scan electrodes to once distinguish the sustaining discharge conducted up to this point of time.

Subsequently, priming pulse 36 is applied to all sustaining electrodes 18 to accomplish in the overall panel region a priming discharge to generate priming particles as seeds or sources of discharge in the write operation of display data.

Thereafter, to prevent the priming discharge from immediately following the sustaining discharge, priming clear pulse 37 is applied to all scan electrodes 17.

According to scan pulse 33 applied to scan electrodes $S_1$, $S_2$, . . . , $S_m$ and data pulse 34 applied to column electrodes $Da_1$, $Da_2$, . . . , $Da_{n-1}$, $Da_n$, there is carried out write discharge for display data.

The data voltage waveforms of FIG. 3 indicate that data is written in display cells $a_{11}$ and $a_{22}$, whereas data is not written in display cells $a_{12}$ and $a_{21}$. Moreover, the display operation is achieved according to presence or absence of data for the display cells other than $a_{11}$, $a_{22}$, $a_{12}$ and $a_{21}$ of first and second rows and those of third and subsequent rows.

In a display cell 24 (reference is to be made to FIG. 2) in which write discharge has occurred, display discharge is conducted between scan electrode 17 and sustaining electrode 18 according to sustaining pulses 31 and 32. Luminance of display is controlled by the number of operations of applying sustaining pulses 31 and 32.

However, in the panel driving method of the prior art, data pulses are utilized to write display data in the pertinent cells by applying voltage thereof to the column electrodes. For such data pulses, each time data is written in each scan line, it is required to charge and to discharge electrostatic capacity for the scan lines other than the scan line in which data is written. Additionally, it is necessary to charge and to discharge electrostatic capacity between the adjacent column electrodes. This consequently results in a drawback that electric power is consumed for data writing operation in addition to that inherently required for the data display.

To solve the problem above, for example, in accordance with the Japanese Patent Publication No. Hei-5-81912, there has been proposed a so-called charge collecting circuit for collecting charge and discharge power of electrostatic capacity conducted by data pulses in a plasma panel.

FIG. 4 shows the charge collecting circuit including electrostatic capacity $C_{100}$ of direct-current (dc) power source, external capacity $C_{101}$, equivalent capacity of column electrode $C_{102}$, high-voltage switches $S_{100}$, $S_{101}$, $S_{102}$, and $S_{103}$; diodes $D_{100}$, $D_{101}$, $D_{102}$, and $D_{103}$, and a coil $L_{100}$.

When the number of column electrodes to be charged to a high potential is altered according to data signals, the equivalent capacity of column electrode $C_{102}$ is also varied. Changed in relation thereto is the (resonance) frequency of a resonant circuit including coil $L_{100}$ and a parallel capacity resultant from equivalent capacity $C_{102}$ and external capacity $C_{101}$. Accordingly, it is required to regulate points of timing to turn switches $S_{100}$ and $S_{101}$ off. If the switch regulating operation is missing, the power loss is increased in the collection circuit and hence the power collecting efficiency is considerably decreased.

The timing adjustment has been described in the Japanese Patent Publication No. Hei-5-81912, which is applicable to an electroluminescent panel requiring a relatively low operation speed (the rising or falling time of the data pulse applied to column electrodes is several microseconds (μs) or more) for the following reason.

That is, switching elements such as field-effect transistors having an operation delay of about 0.1 μs to about 0.2 μs can be adopted for switches $S_{100}$ and $S_{101}$.

However, in a plasma display (the rising or falling time of the data pulse applied to column electrodes is about 0.3 μs or less) for which a very high operation speed is required when compared with the electroluminescent panel, there is missing a switch having a high operation speed (desirably, the operation delay is 0.1 μs or less) sufficiently cope with the rising or falling time.

Consequently, the power collecting circuit described in the Japanese Publication has a drawback that the circuit cannot sufficiency cope with the high operation speed.

SUMMARY OF THE INVENTION

It is therefore an object of the present invention to provide a charge collection circuit applicable to such a display panel requiring a high operation speed as a plasma display panel and a circuit configuration of an integrated circuit suitable for the charge collection circuit.

To achive the object above in accordance with the present invention, there is provided a driver circuit for applying data pulses to column electrodes of a display panel which at least includes a plurality of row electrodes formed in a plane in parallel to each other and a plurality of column electrodes formed to be isolated from the row electrodes, parallel to each other, and orthogonal to the row electrodes, the driver circuit including a circuit for collecting charge of data pulses. The charge collecting circuit comprises a capacitor for collecting charge therein and an auxiliary capacitor and switching means arranged between a terminal of the charge collecting capacitor and a data voltage input terminal supplying data voltage to an integrated circuit (IC) to drive the column electrodes, the switching means controlling a current in a direction in which charge is collected and passing therethrough a current in a direction in which charge is supplied to the column electrodes of the display panel. The auxiliary capacitor is connected between the data voltage input terminal and a ground potential. The charge collecting capacitor has another terminal connected to a ground potential.

In accordance with the present invention, the data voltage input terminal is favorably connected via an inductance element to the switching means. Additionally, there may be arranged a switch between the data voltage input terminal and a power source terminal. Moreover, one of the terminals of the charge collecting capacitor is connected to a voltage source supplying a fixed voltage of about one half of the data voltage.

In addition, in accordance with the present invention, there are provided a differentiater circuit connected to the data voltage input terminal of the IC to drive column electrodes and a comparator for transforming an output from the differentiater circuit into a digital signal. Operation timing of switches which is resistive against a high voltage and which disposed in the IC to drives the column electrodes and a switch having a terminal connected to the coil and another terminal connected to the data voltage source is controlled in response to pulses produced from the comparator.

Furthermore, in accordance with a second aspect of the present invention, there is provided a circuit for collecting charge of data pulses in which a data input terminal of an integrated circuit (IC) to drive the column electrodes is connected to a coil for collecting charge and a switch having another terminal connected to a data voltage source. Another end of the coil is connected to a switching unit respectively controlling currents flowing from and into the coil. Another end of the switching unit is connected to a terminal of a charge collecting capacitor having another terminal grounded and to a voltage source of about one half of the data voltage.

In accordance with the second aspect of the present invention, the data voltage input terminal of the IC to drive the column electrodes is connected to a terminal of an auxiliary capacitor having another terminal grounded.

Furthermore, in accordance with a third aspect of the present invention, there is provided a circuit for collecting charge of data pulses in which the integrated circuit (IC) to drive the column electrodes includes one or a plurality of switching unit or units resistive against a high voltage. The switching unit includes a first switch connected between a data voltage input terminal to supply a data voltage to the IC and an output terminal, a second switch connected between the output terminal and a ground terminal in the IC, a third switch having a terminal connected to the output terminal and another terminal connected to a first charge collecting terminal, and a fourth switch having a terminal connected to the output terminal and another terminal connected to a second charge collecting terminal. The data voltage input terminal is connected to a data voltage source. The first charge collecting terminal is connected to a terminal of a first coil having another terminal connected to a cathode of a first diode. The second charge collecting terminal is connected to a terminal of a second coil having another terminal connected to an anode of a second diode. An anode and a cathode respectively of the first and second diodes are commonly connected to each other to be connected to a terminal of a charge collecting capacitor having another terminal connected to a ground potential. The commonly connected point of the anode and the cathode is connected to a voltage source of substantially one half of the data voltage.

Additionally, in accordance with a fourth aspect of the present invention, there is disposed an integrated circuit (IC) to drive the column electrodes including one or a plurality of switching unit or units resistive against a high voltage. The switching unit includes a first switch connected between a data voltage input terminal to supply a data voltage to the IC and an output terminal, a second switch connected between the output terminal and a ground terminal in the IC, and a third switch having a terminal connected to the output terminal and another terminal connected to a charge collecting terminal. The data voltage input terminal of the IC to drive the column electrodes is connected to a data voltage source. The charge collecting terminal is connected to a terminal of a coil having another terminal connected to a contact point of a switching unit controlling currents respectively flowing from and into the coil. Another contact point of the switching unit commonly connected the second charge collecting terminal is commonly connected to a terminal of a charge collecting capacitor having another terminal grounded and to a voltage source of substantially one half of the data voltage.

Furthermore, in accordance with a fifth aspect of the present invention, there is arranged an integrated circuit (IC) to drive the column electrodes including one or a plurality of switching unit or units resistive against a high voltage. The switching unit includes a first switch connected between a data voltage input terminal to supply a data voltage to the IC and an output terminal, a second switch connected between the output terminal and a ground terminal in the IC, a third switch having a terminal connected to the output terminal and another terminal connected to a first charge collecting terminal, and a fourth switch having a terminal connected to the output terminal and another terminal connected to a second charge collecting terminal. The data voltage input terminal of the IC to drive the column electrodes is connected to a data voltage source. The first charge collecting terminal is connected to an anode of a diode having another terminal connected to the data voltage source, a cathode of a diode having another terminal grounded, and a cathode of a diode having another terminal connected to a charge collecting coil. The second charge collecting terminal is connected to an anode of a diode having another terminal connected to the data voltage source, a cathode of a diode having another terminal grounded, and the charge collecting coil having another terminal connected to the anode of a diode having another terminal connected to the first charge collecting terminal.

In accordance with the present invention, in either one of the aspects above, charge of capacitive column electrodes are effectively gathered to be stored in charge collecting capacitors and it is possible to efficiently reduce power of data pulses to be applied to the integrated circuits to drive the column electrodes.

Additionally, in accordance with the present invention, when the potential of the data voltage input terminal becomes equal to or less than a predetermined level or becomes a minimum value after a predetermined period of time relative to initiation of operation of the charge collecting circuit, the FET of the integrated circuit to drive the column electrodes is turned on or off. Consequently, the charge is collected most efficiently and the supply of data voltage from the data source to the integrated circuit can be controlled to optimize the collection of charge.

Furthermore, when compared the second aspect of the present invention with the conventional example in which the switch to control a large current is required to be controlled at precise timing, such a highly precise control operation of timing is unnecessary in accordance with the present invention. In short, while controlling transition between the on and off states of the switch at a fixed point of timing for any FETs, there can be materialized a driving circuit on the data side having a high charge collecting efficiency in accordance with the present invention. In addition, since the operation of the circuit system is kept normal even when falling or rising time T of data pulses becomes small, it may also be possible to dispense with the auxiliary capacitor in accordance with the present invention.

In accordance with the third aspect of the present invention, the effect of saving of data pulse power can be remarkably increased by cooperatively using successive data pulses and charge collection. Moreover, since the transition between the on and off states takes place during the same period of time for the respective column electrodes, the period of time necessary for the state transition can be minimized, leading to a high operation speed of the system.

Additionally, in accordance with the fourth aspect of the present invention, the power saving effect of data pulse power can be considerably enhanced thanks to adoption of successive data pulses and charge collection. In this case, the transition between the on and off states cannot be conducted during the same period of time for the respective column electrodes. Consequently, although the period of time necessary for the transition is elongated, the configurations respectively of the charge collecting circuit and the integrated circuit to drive the column electrodes can be advantageously simplified.

Moreover, in accordance with the fifth aspect of the present invention, the effect of saving of data pulse power can be remarkably increased by use of successive data pulses and charge collection, and the transition between the on and off states occurs during the same period of time for the respective column electrodes and hence the period of time required for the state transition can be reduced, which results in a high operation speed. In addition, in accordance with the present invention, it is possible to minimize the number of externally arranged parts of the integrated circuit to drive the column electrode, and the parts substantially include passive elements not requiring any special control signals. Consequently, the circuit structure can be quite simplified.

BRIEF DESCRIPTION OF THE DRAWINGS

The objects and features of the present invention will become more apparent from the consideration of the following detailed description taken in conjunction with the accompanying drawings wherein:

FIG. 10 is a graph showing operation waveforms of the third embodiment in accordance with the present invention;

FIG. 14 is a graph showing operation waveforms of the fifth embodiment in accordance with the present invention.

DESCRIPTION OF THE PREFERRED EMBODIMENTS

Referring now to the accompanying drawings, description will be given of an embodiment in accordance with the present invention. As an example of the display panel, there will be employed the plasma display panel described in conjunction with FIGS. 1 and 2 above. Description will be given of a driver circuit to drive the plasma display panel in accordance with the present invention.

The display panel includes 240 scan electrodes 17, 240 sustaining electrodes 18, and 960 column electrodes. The pitch of display cells is 0.4 millimeter (mm) along the direction of scan electrodes 17 and 1.2 mm along the direction vertical to that of scan electrodes 17. Between each column electrodes and its adjacent column electrodes, there is a capacity of 37 picofarads (pF). Between each column electrode and all scan and sustaining electrodes, there exists a capacity of 12 pF.

The column electrodes are classified into four blocks. Each block is provided with a charge collecting circuit. The block includes 240 column electrodes, and when half thereof, namely, 120 column electrodes are selected, there is developed a maximum electrostatic capacity of six nanofarads (nF).

Incidentally, a field-effect transistor (FET) is employed as a switching unit to turn a high voltage on and off in the following embodiments.

Figure 5:
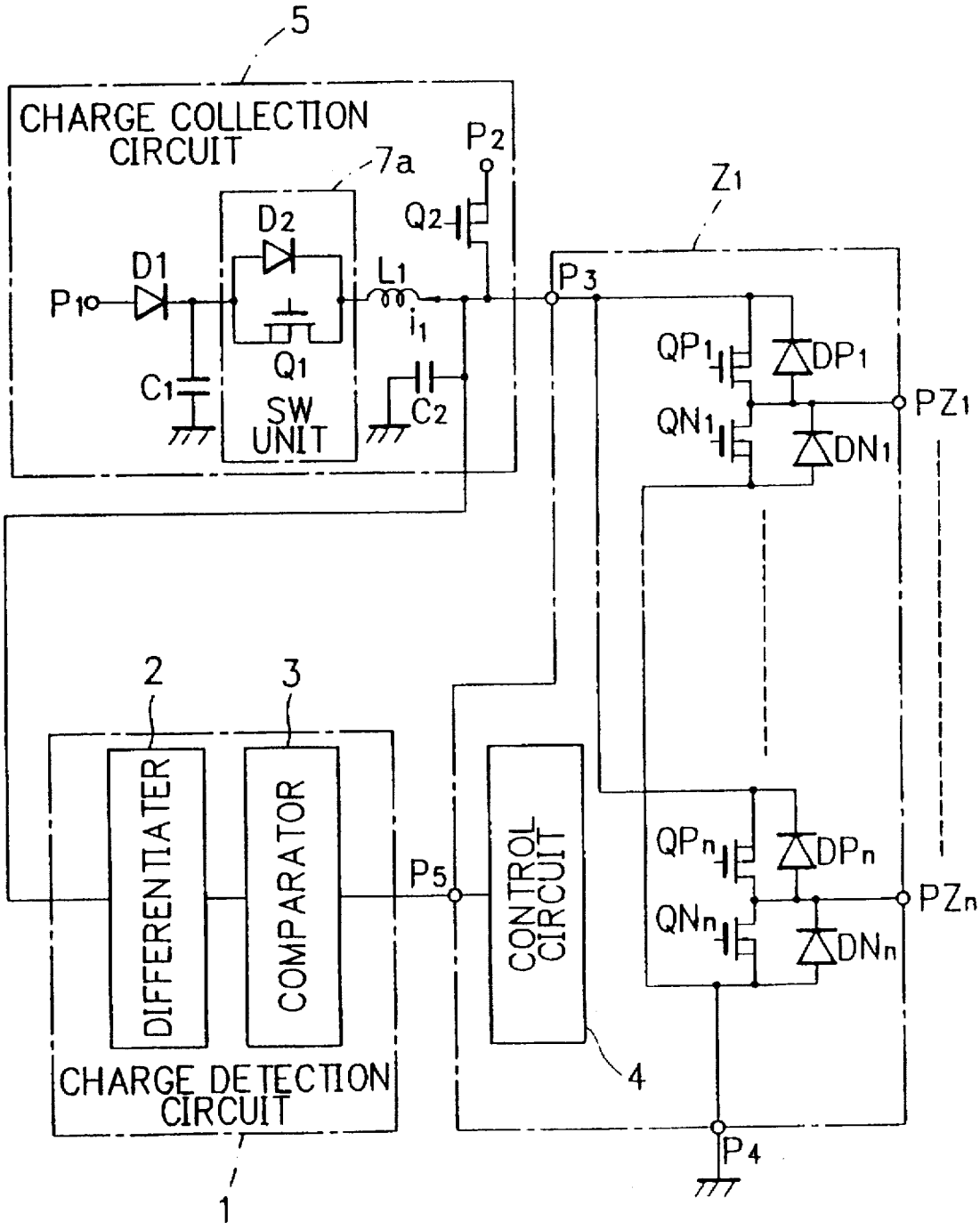
FIG. 5 is a schematic diagram showing the configuration of a first embodiment in accordance with the present invention.

FIG. 5 shows constitution of a first embodiment of a driver circuit in accordance with the present invention. This system includes a circuit described in the Japanese Patent Publication No. Sho-56-30730 in which the circuit is combined with an integrated circuit (IC) to drive column electrodes so as to gather charge on the data side at a high speed.

Referring now to FIG. 5, the embodiment basically includes an integrated circuit $Z_1$ to drive column electrodes and a charge collecting circuit. Preferably, the embodiment may include a charge detection circuit 1 including a differentiater 2 and a comparator 8 and a control circuit 4. The comparator 3 detects an event that a zero voltage is passed through the differentiater 2 and then sends a detection or sense signal of the condition to the control circuit 4.

In the charge collection collecting circuit 5, $P_1$, indicates a terminal to apply a dc voltage for charge collection, i.e., one half of data voltage Vd. and $P_2$ stands for a terminal to apply a dc voltage of data voltage Vd.

$D_1$ and $D_2$ are diodes, $C_1$ denotes a charge collecting capacitor having an electrostatic capacity of at least about 100 times that of the composite electrostatic capacity of column electrodes for charge collection and an auxiliary capacitor, and $C_2$ is an auxiliary capacitor (having an electrostatic capacity of 4 nF) to reduce the rate or change in the collected electrostatic capacity due to variation in the electrostatic capacity of the column electrodes for charge collection.

$Q_1$ designated an n-channel FET and $Q_2$ is a p-channel FET inserted between the terminals $P_2$ and $P_3$. The n-channel FET ($Q_1$) and diode $D_2$ constitute a switching unit 7*a*.

$L_1$ represents a charge collecting coil (having inductance of one microhenry (μH) including a terminal connected to a common connecting point of a cathode of the diode $D_2$ and the FET ($Q_1$) and another terminal linked with the terminal $P_3$.

For the IC ($Z_1$), $P_3$ is a data voltage input terminal, whereas $PZ_1$ to $PZ_n$ indicate output terminals connected to the respective column electrodes. $P_4$ is a ground terminal and $P_5$ denotes an input signal terminal of the control circuit 4 in the IC ($Z_1$). $QN_1$ to $QN_n$ designate n-channel FETs resistive against a high voltage and $QP_1$ to $QP_n$ denote p-channel FETs resistive against a high voltage. $DN_1$ to $DN_n$ designate parasitic diodes respectively of the n-channel FETs $QN_1$ to $QN_n$, whereas $DP_1$ to $DP_n$ represent parasitic diodes respectively of the p-channel FETs $QP_1$ to $QP_n$.

In this connection, terminal $P_1$ is applied with a fixed voltage from a voltage source (not shown), the voltage is about one half of data voltage Vd such that when the potential between the terminals of charge collecting capacitor $C_1$ becomes about one half of data voltage Vd, charge collecting capacitor $C_1$ is charged via diode $D_1$, thereby keeping the potential between the terminals of capacitor $C_1$ continuously at about one half of data voltage Vd.

Figure 6:
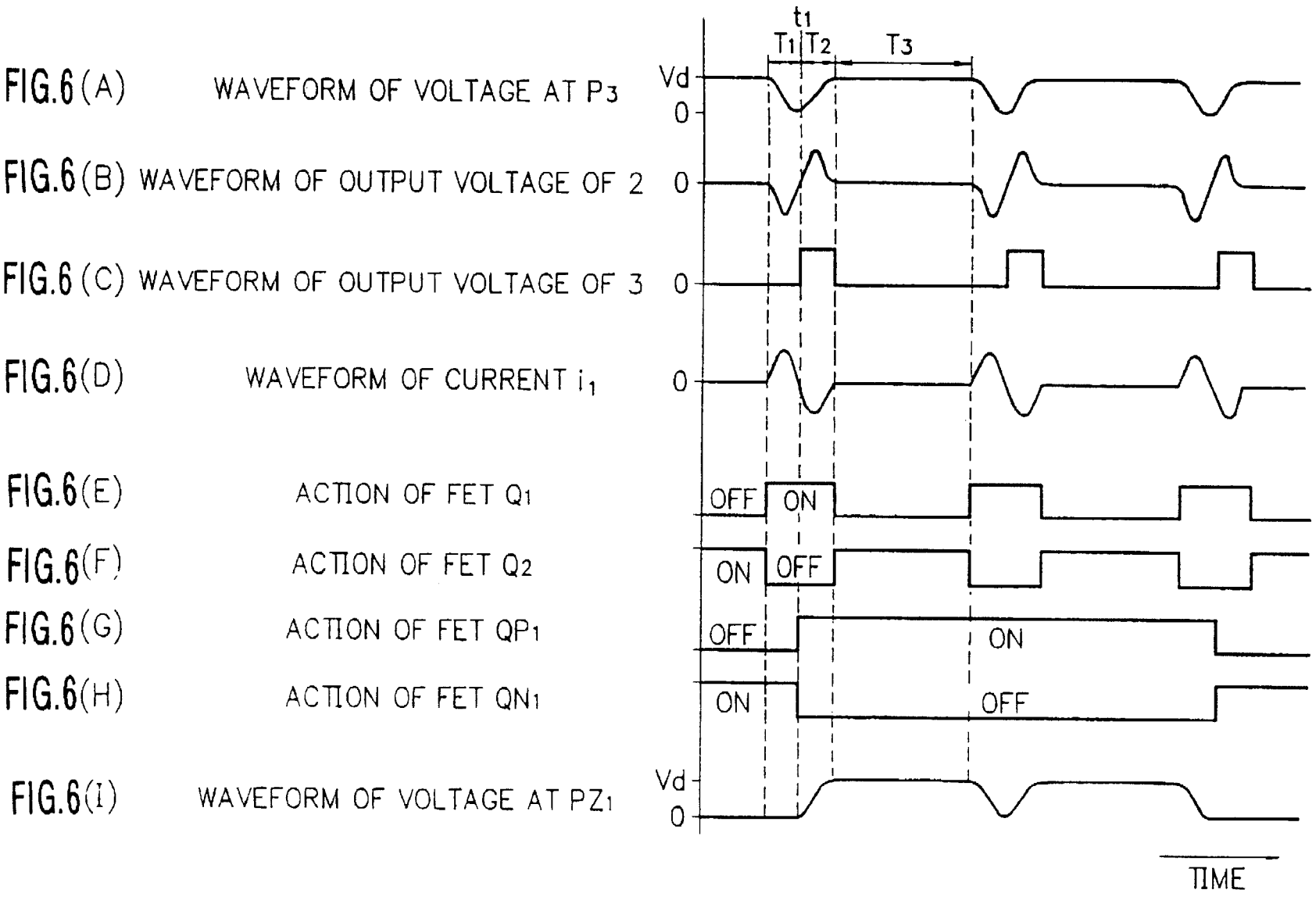
FIG. 6 is a graph showing operation waveforms of the first embodiment in accordance with the present invention.

FIG. 6 shows waveforms of voltages and currents of the circuit in accordance with the present invention.

In period $T_1$, FET $Q_1$ of switch unit 7*a* becomes conductive to discharge electric charge from auxiliary capacitor $C_2$ via coil $L_1$ and FET $Q_1$ to collecting capacitor $C_1$.

Additionally, charge stored in column electrodes to which the pulse voltage is applied is discharged to be gathered in collecting capacitor $C_1$ through terminals $PZ_i$ (i ranges from one to n and indicates a number assigned to a selected terminal), diodes $DP_i$ (i ranges from one to n and indicates a number assigned to a selected terminal), coil $L_1$, and FET $Q_1$.

At the end of period $T_1$, voltage waveform (A) at terminal $P_3$ takes a minimum value which is almost zero.

In period $T_2$, electric charge is transferred to auxiliary capacitor $C_2$ through diode $D_2$ of switch unit 7*a* and coil $L_1$. That is, referring to FIG. 2 (D), the direction of current $i_1$ flowing through coil $L_1$ is reversed when compared with that of current $i_1$ during period $T_1$ so as to charge auxiliary capacitor $C_2$.

Furthermore, in period $T_2$, charge is passed through diode $D_2$, coil $L_1$, and FETs $QP_i$ (i ranges from one to n and indicates a number assigned to a selected terminal) set to the on state in association with presence of data thereof to charge the associated column electrodes.

On the occasion, since the charging operation is carried out via coil $L_1$, there takes place only a small power loss due to resistance in the circuit.

Since p-channel FETs $QP_i$ and n-channel FETs $QN_i$ (i=1 to n) complementarily cooperate with each other, when $QP_i$ is on, $QN_i$ is off.

During period $T_2$, the potential of terminal $P_3$ is increased to a value in the vicinity of data voltage Vd. Incidentally, FET $Q_1$ of switch unit 7*a* may be on or off during period $T_2$.

In period $T_3$, p-channel FET $Q_2$ is turned on and then the voltage of terminal $P_3$ is clamped to be limited to data voltage Vd. In addition, the voltage of each column electrode is fixed to voltage Vd by FET $QP_i$ in IC $Z_1$ according to FET $Q_2$ in the on state and presence of data. Alternatively, the voltage is set to the zero voltage by FET $QN_i$ in IC $Z_1$ according to absence of data. Through the operation above, charge related to data pulses is collected and data is written in the associated cells.

Subsequently, description will be given of the control operation of timing when FETs $QN_1$, $QN_2$, . . . , $QN_n$ and FETs $QP_1$, $QP_2$, . . . , $QP_n$ of IC $Z_i$, are turned on or off or timing when FET $Q_2$ is turned on.

When period $T_1$ lapses from initiation of operation of charge collecting circuit 5, terminal $P_3$ develops a minimum voltage. At this point, if FETs $QN_1$, $QN_2$, . . . , $QN_n$ and FETs $QP_1$, $QP_2$, . . . , $QP_n$ are turned on or off in IC $Z_1$, the charge collecting efficiency takes a maximum value.

Additionally, timing to turn FET $Q_2$ on is desirably after lapse of a period obtained by adding period $T_1$ to period $T_2$. If the FET $Q_2$ is earlier turned on, the charge collecting efficiency will be lowered.

In this situation, differentiating the voltage waveform of terminal $P_3$ results in waveform (B) of FIG. 6. Waveform (B) is then shaped by comparator 3 to attain waveform (C) of FIG. 6.

Figure 2:
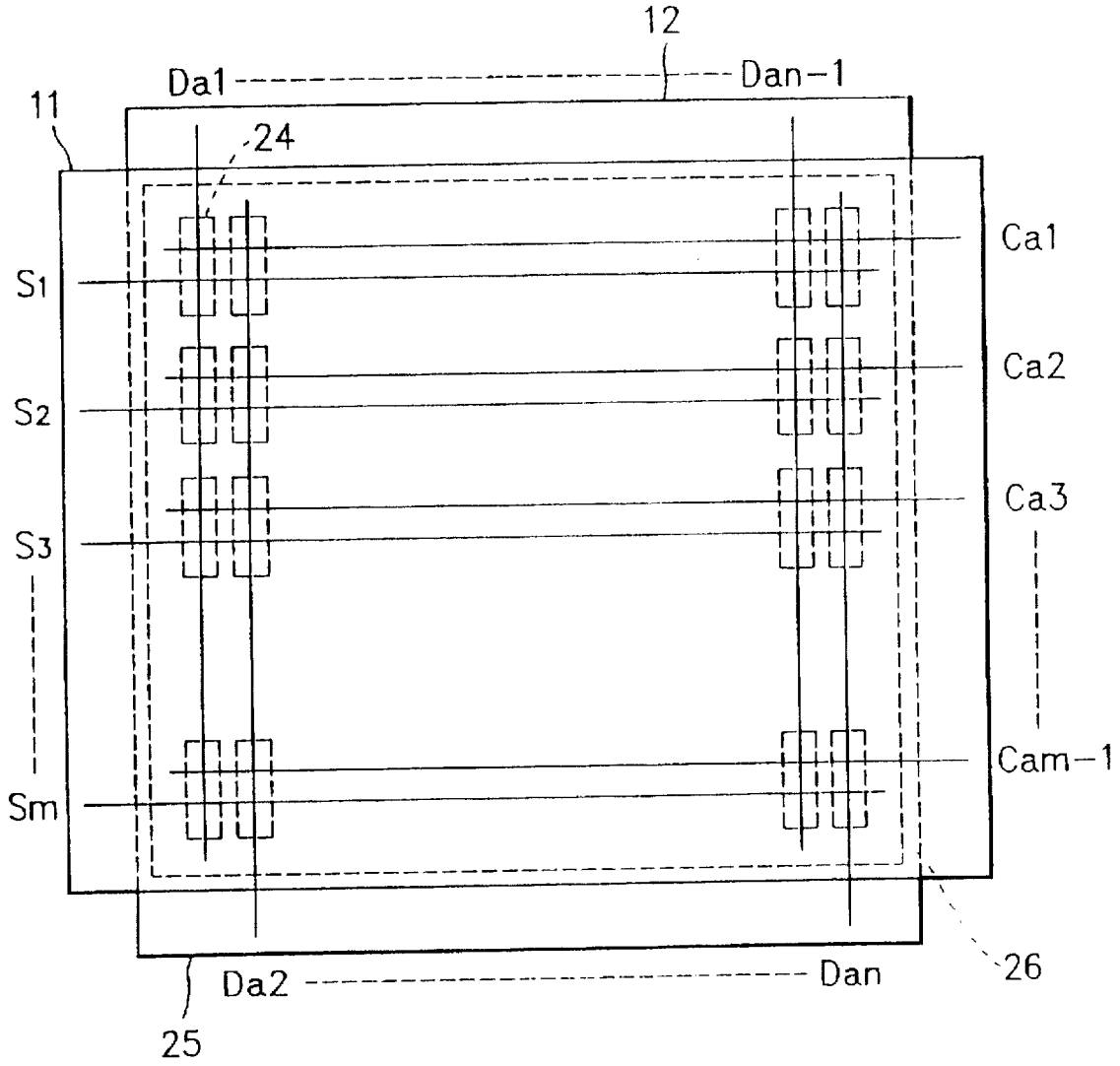
FIG. 2 PRIOR ART
FIG. 2 is a diagram showing arrangement of electrodes of the conventional plasma display panel of ac planar discharge type.

At a rising point of wave form outputted from comparator 3 (reference is to be made to (C) of FIG. 2), there is conducted an operation to control points of timing to turn FETs $QN_1$, $QN_2$, . . . , $QN_n$ and FETs $QP_1$, $QP_2$ . . . , $QP_n$ of IC $Z_1$, on or off. Furthermore, a point of timing to turn FET $Q_2$ on is controlled at a falling edge of waveform produced from comparator 3.

Incidentally, comparing waveform (D) of FIG. 2 of current $i_1$ flowing into coil $L_1$ (or flowing from coil $L_1$) with output voltage waveform (B) of FIG. 2 of differentiater 2, it can be understood that the input to comparator 3 need not be necessarily the waveform obtained by differentiating the voltage at terminal $P_3$. Namely, a waveform of current $i_1$ may be detected to be supplied to comparator 3.

Next, periods $T_1$ and $T_2$ will be attained as numeric values in accordance with the embodiment. Falling (or rising) time T of a data pulse is approximated according to expression (1) as follows when the value of inductance of coil $L_1$ is L and the value of parallel composite electrostatic capacity of column electrodes from which the data is to be removed (or to which the data pulse is to be applied) is represented as C.

$$T=\pi(LC)^{1/2} \quad (1)$$

Assume that the inductance of coil $L_1$ is one microhenry (μH), electrostatic capacity of auxiliary capacitor $C_2$ is 4 nF, and electrostatic capacity of column electrodes ranges from about 0 nF to about 6 nF.

Assigning these values to expression (1), time T is obtained as follows.

T=0.20 to 0.31 microsecond (μs)

In comparison with the embodiment, a switch to control a large current is required to be regulated at an exact timing in the conventional example. Such a timing control operation has been quite difficult.

In the embodiment, the strict timing control need only be achieved by FETs $QN_1$, $QN_2$, . . . , $QN_n$ and FETs $QP_1$, $QP_2$, . . . , $QP_n$ of IC $Z_1$.

Figure 4:
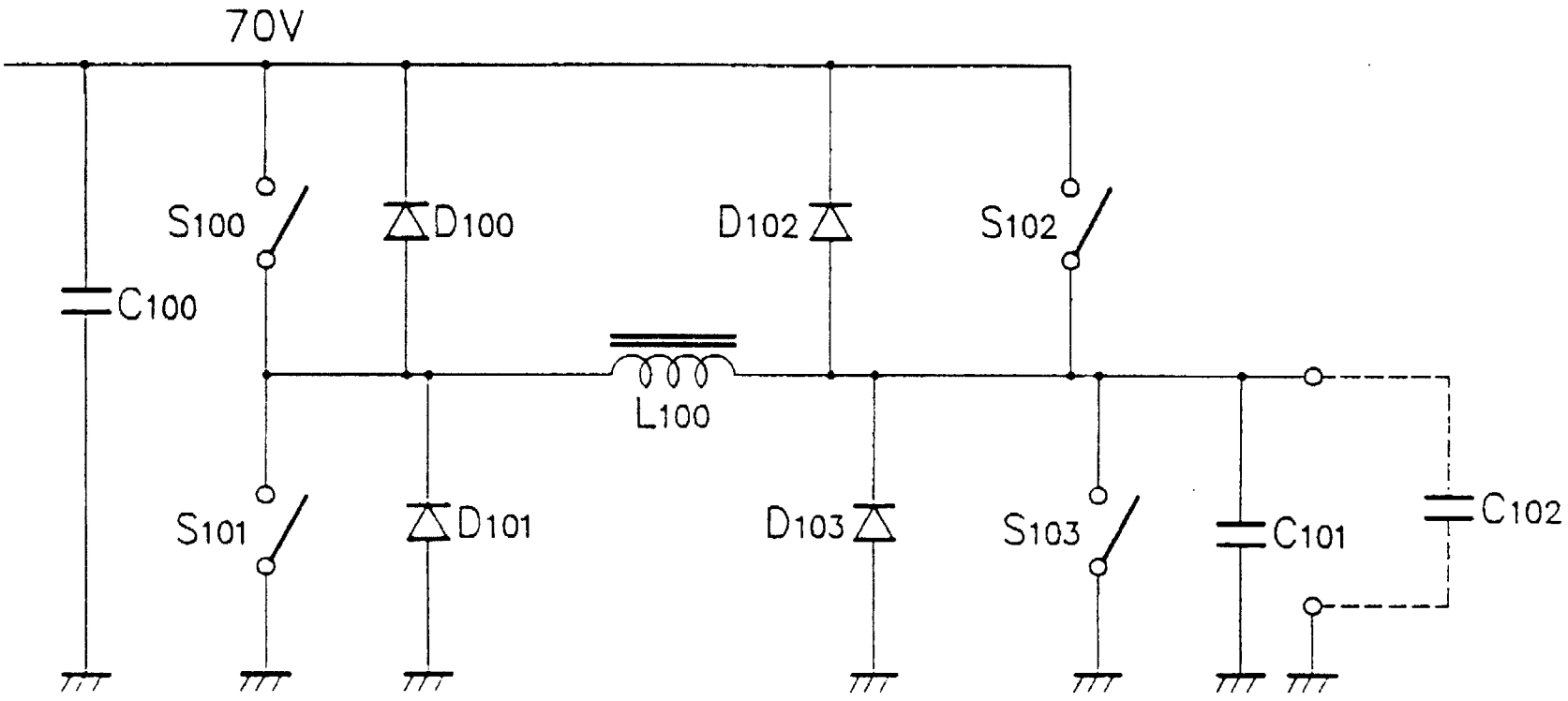
FIG. 4 PRIOR ART
FIG. 4 is a diagram showing structure of a charge collecting circuit of the prior art.

Since each of the FETs outputs a small current, it is possible to achieve a high-speed switching operation. Consequently, there is implemented an efficient charge collection on the data side, which has been difficult in the prior art. Furthermore, since FET $Q_2$ operates in a manner similar to that of switch $S_{102}$ of the conventional example shown in FIG. 4, there is not required any particular change in the system.

In this regard, in case where the charge collecting efficiency may be slightly lowered, voltage detecting circuit 1 may be removed to fixedly set periods of time $T_1$ and $T_2$.

In the embodiment above, period $T_1$ and $T_2$ may be set to a range from about 0.20 μs to about 0.31 μs, preferably, fixed to about 0.25 μs in operation.

Moreover, although the example includes diode $D_2$, when an FET is adopted as a switch as above, diode $D_2$ of FIG. 5 may be dispensed with by using the parasitic diode of FET $Q_1$.

As described above, the controllability of the charge collecting circuit of the first embodiment is remarkably improved when compared with the prior art. However, to attain a high collecting efficiency, there is required the high-speed voltage detector 1 to adjust operation timing.

To solve the problem, a switch need only be employed in place of diode $D_2$. Description will now be given of a second embodiment including such a switch in accordance with the present invention.

Figure 7:
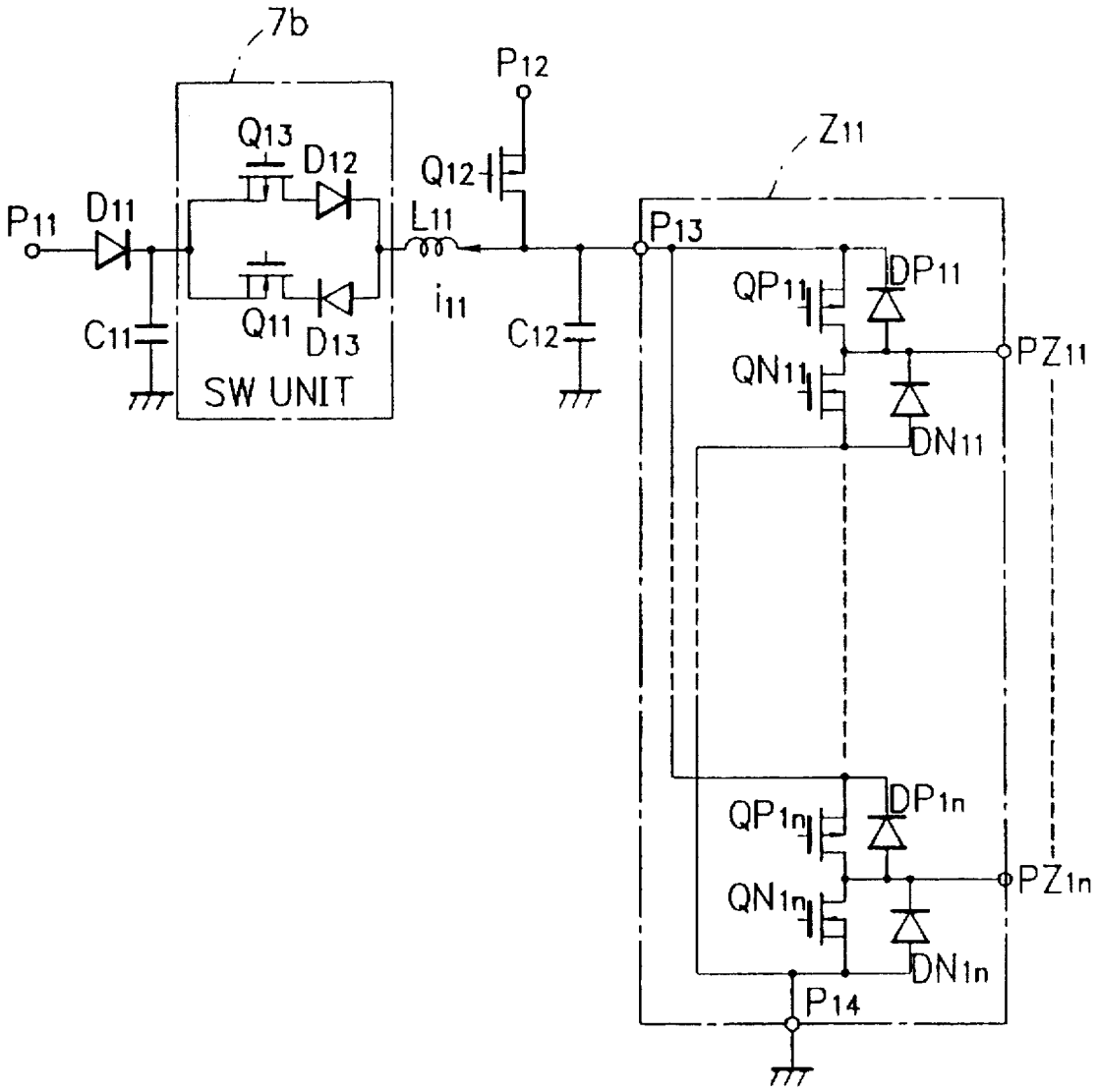
FIG. 7 is a diagram showing the configuration of a second embodiment in accordance with the present invention.

Referring now to FIG. 7 showing the circuit configuration of the second embodiment in accordance with the present invention, $Z_{11}$ indicates an integrated circuit (IC) resistive against a high voltage to drive column electrodes, $P_{11}$ designates a terminal to apply a charge collecting dc voltage which is about one half of data voltage Vd, $P_{12}$ represents a terminal to apply a dc voltage of data voltage Vd, $P_{13}$ stands for a data voltage input terminal of IC $Z_{11}$, $P_{14}$ is a ground terminal of IC $Z_{11}$; $D_{11}$, $D_{12}$, and $D_{13}$ are diodes, $C_{11}$ indicates a charge collecting capacity having an electrostatic capacity which is at least about 100 times the composite electrostatic capacity of column electrodes for charge collection and an auxiliary capacitor, $C_{12}$ is an auxiliary capacitor (having an electrostatic capacity of 4 nF) to reduce the variation rate of the collected electrostatic capacity due to the change in the electrostatic capacity of column electrodes for charge collection. $L_{11}$ denotes a charge collecting coil (having an inductance of 1 μH), $Q_{11}$ is an n-channel FET; $Q_{12}$ and $Q_{13}$ are p-channel FETs; $QN_{11}$, . . . , $QN_{1n}$ denote n-channel FETs resistive against a high voltage in IC $Z_{11}$; $QP_{11}$, . . . , $QP_{1n}$ are p-channel FETs resistive against a high voltage in IC $Z_{11}$; $DN_{11}$, . . . , $DN_{1n}$ stand for parasitic diodes respectively of n-channel FETs $QN_{11}$, . . . , $QN_{1n}$; $DP_{11}$, . . . , $DP_{1n}$ are parasitic diodes respectively of p-channel FETs $QP_{11}$, . . . , $QP_{1n}$; $PZ_{11}$, . . . , $PZ_{1n}$ designate output terminals of IC $Z_{11}$ connected to the respective column electrodes. *7b* indicates a switching unit including FET $Q_{11}$ and $Q_{13}$ and diodes $D_{12}$ and $D_{13}$.

Figure 8:
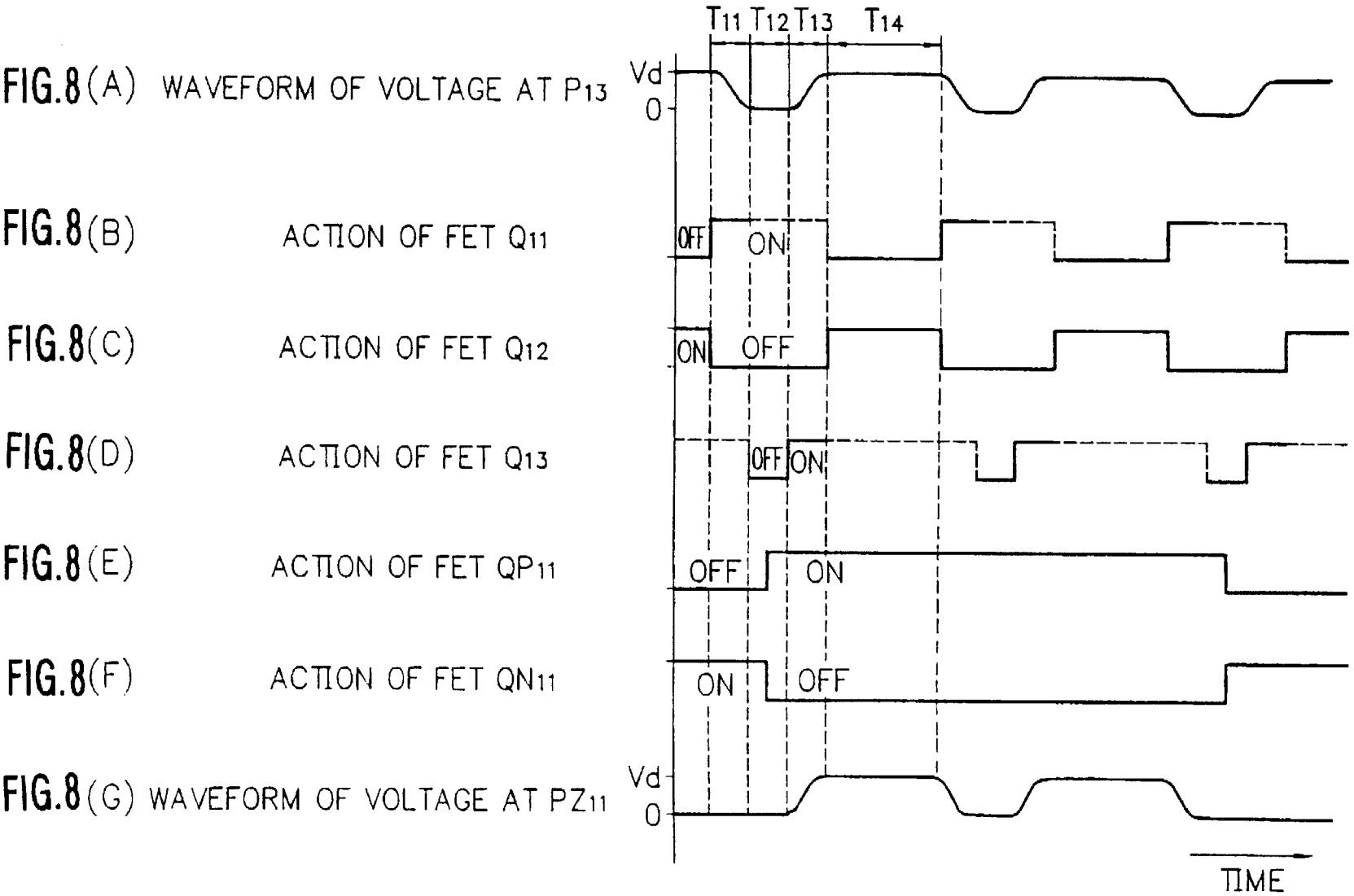
FIG. 8 is a graph showing operation waveforms of the second embodiment in accordance with the present invention.

FIG. 8 shows waveforms of voltages and currents of the second embodiment of the driver circuit in accordance with the present invention.

Figure 3:
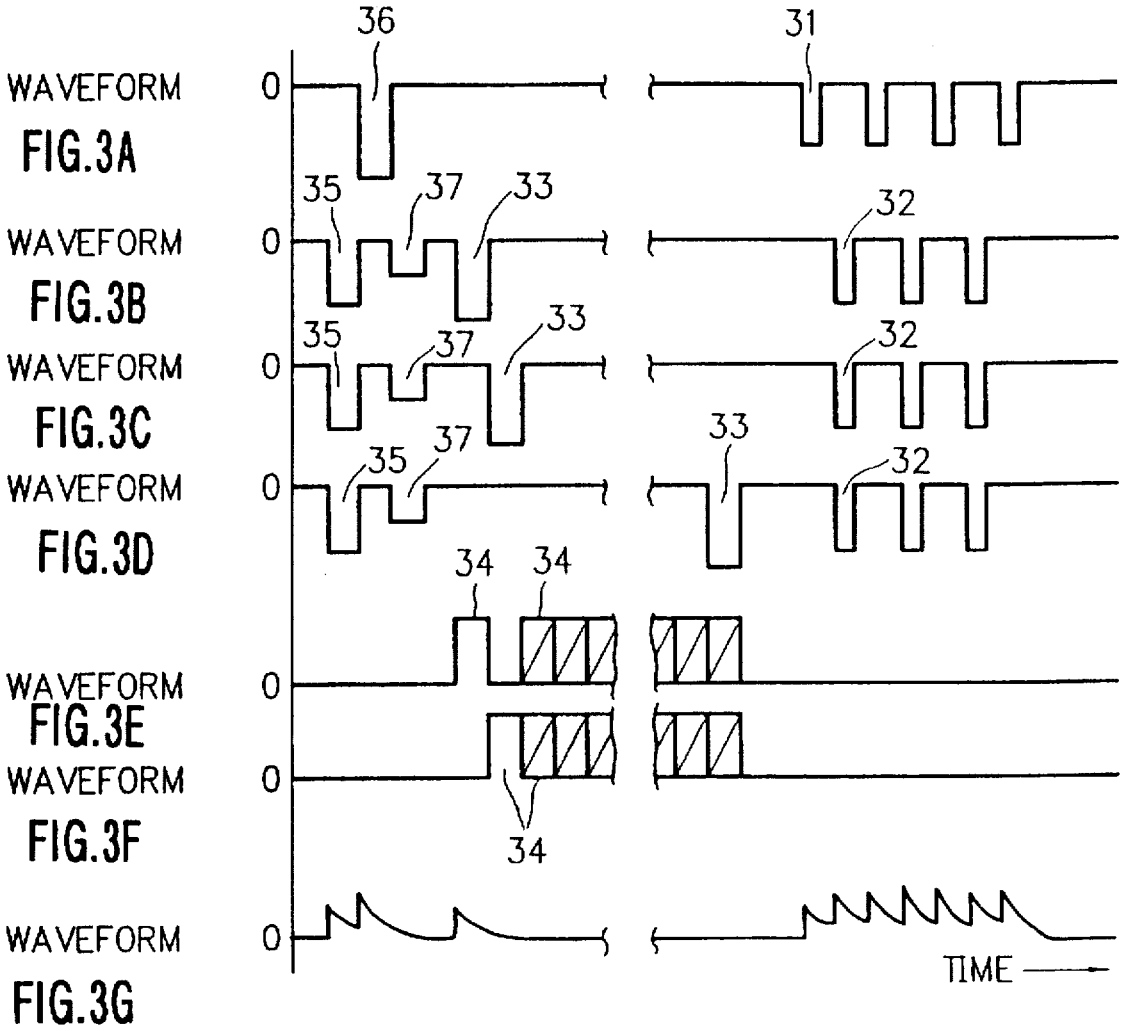
FIG. 3 is a graph showing waveforms of signals to drive the conventional plasma display panel of ac planar discharge type.

During period $T_{11}$, FET $Q_{11}$ is conductive and hence electric charge stored in auxiliary capacitor $C_{12}$ is fed to collecting capacitor $C_{11}$ via coil $L_{11}$, diode $D_{13}$, and FET $Q_{11}$. Moreover, charge kept in column electrodes are gathered in collecting capacitor $C_{11}$ via diodes $DP_{1i}$ (i ranges from one to n and indicates a number assigned to a selected terminal). coil $L_{11}$, diode $D_{13}$, and FET $Q_{11}$. When period $T_{11}$ is terminated, waveform (A) of FIG. 3 at terminal $P_{13}$ takes a minimum value approximately zero. Incidentally, FET $Q_{13}$ may be on or off during this period, which is indicated by broken lines in (D) of FIG. 8.

In period $T_{12}$, transition from on to off or vice versa takes place in n-channel FETs $QN_{11}$, $QN_{12}$, . . . , $QN_{1n}$ and p-channel FETs $QP_{11}$, $QP_{12}$, . . . , $QP_{1n}$ of IC $Z_{11}$. FETs $QP_{1i}$ and FETs $QN_{1i}$ accomplish mutually complementary operations and hence when $QP_{1i}$ is on, $QN_{1i}$ is off. In this regard, FET $Q_{11}$ may be on or off during this period as indicated by broken lines in (B) of FIG. 8.

During period $T_{13}$, FET $Q_{13}$ becomes conductive and therefore auxiliary capacitor $C_{12}$ is charged through diode $D_{12}$, FET $Q_{13}$, and coil $L_{11}$. Furthermore, in concurrence therewith, via FET $Q_{13}$, diode $D_{12}$, coil $L_{11}$, and FETs $QP_{1i}$ (i ranges from one to n and indicates a number assigned to a selected terminal) of which the on state is selected according to presence of data thereof, the respective column electrodes are charged and data pulses are created. Since the charging operation is carried out through coil $L_{11}$, there occurs only a small power loss due to resistance in the circuit. The voltage of terminal $P_{13}$ is increased to a value near data voltage Vd. Incidentally, FET $Q_{11}$ may be on or off during this period. This is indicated by broken lines in (B) of FIG. 8.

During period $T_{14}$, FET $Q_{12}$ is turned on and hence the potential of terminal $P_{13}$ is clamped by data voltage Vd. Additionally, the voltage of each column electrode is fixed to voltage Vd by FET $QP_{1i}$ of IC $Z_{11}$ according to FET $Q_{12}$ in the on state and presence of data; or, the voltage is fixedly set to the zero voltage by FET $QN_{1i}$ of IC $Z_{11}$ according to absence of data. Incidentally, FET $Q_{13}$ may be on or off during this period, which is indicated by broken lines in (D) of FIG. 8.

Through the operation above, charge of data pulses is collected and data is written in cells.

Subsequently, description will be given of point of timing when FETs $QN_{11}$, $QN_{12}$, . . . , $QN_{1n}$ and $QP_{11}$, $QP_{12}$, . . . , $QP_{1n}$ are turned on or off and points of timing to turn FETs $Q_{12}$ and FET $Q_{13}$ on.

Falling or rising time T of a data pulse is about 0.20 microsecond (μs) to about 0.31 μs like in the first embodiment.

First, period $T_{11}$ is set to the maximum value, i.e., 0.31 μs of falling time of the data pulse. With this provision, prior to transition to the on or off state of FETs $QN_{11}$, $QN_{12}$, . . . , $QN_{1n}$ and $QP_{11}$, $QP_{12}$, . . . , $QP_{1n}$ of IC $Z_{11}$, the voltage of terminal $P_{13}$ is guaranteed to take the minimum value and therefore the charge collection is sufficiently accomplished under a fixed condition.

Period $T_{12}$ is set to a value ranging from 0 μs to 0.1 μs, and transition points of timing to the on or off state of FETs $QN_{11}$, $QN_{12}$, . . . , $QN_{1n}$ and $QP_{11}$, $QP_{12}$, . . . , $QP_{1n}$ of IC $Z_{11}$ are set to points in period $T_{12}$, preferably, to points in the central portion thereof. Since it is guaranteed that terminal $P_{13}$ develops the minimum value during this period, the power loss associated with the state transition is minimized.

Like period $T_{11}$, period $T_{13}$ is set to the maximum value, namely, 0.31 μs of rising time of the data pulse. It is to be appreciated that timing to turn FET $Q_{13}$ on is set to the start point of period $T_{13}$.

Timing to turn FET $Q_{12}$ is fixed to an initiating point of period $T_{14}$ after lapse of fixed periods of $T_{11}$, $T_{12}$ and $T_{13}$.

Incidentally, unlike in the first embodiment, even when falling or rising time T of the data pulse is reduced, there arises no problem in the circuit operation in the second embodiment. Therefore, auxiliary capacitor $C_{12}$ may be dispensed with.

When comparing the second embodiment with the conventional example in which the switch to control a large current is required to be adjusted at a precise point of timing, such an exact timing control is unnecessary in the second embodiment. That is, while controlling the on or off transition at fixed points of timing for all FETs, there can be implemented a driver circuit on the data side having a high charge collecting efficiency.

In the first and second embodiments described above, as can be seen from waveform (I) of FIG. 6 and waveform (G) of FIG. 8, the voltage of data pulses applied to all column electrodes is lowered between data pulses applied in time series. These pulses are called "isolated data pulses".

In this connection, data pulses in which pulses are consecutive in time series are favorable when compared with such isolated data pulses for the following reason. Namely, it has been known that the number of on or off transition points of pulses is reduced in the consecutive data pulses and hence the power loss due to operations to turn the data pulse on or off can be lowered to half the original value or less excepting particular display patterns (e.g., a pattern of hound's tooth check).

In the first and second embodiments, it is however impossible to attain both the power saving effect thanks to consecutive data pulses and that due to charge collection. Description will now be given of a third embodiment of a charge collecting circuit capable of solving the problem in accordance with the present invention.

Figure 9:
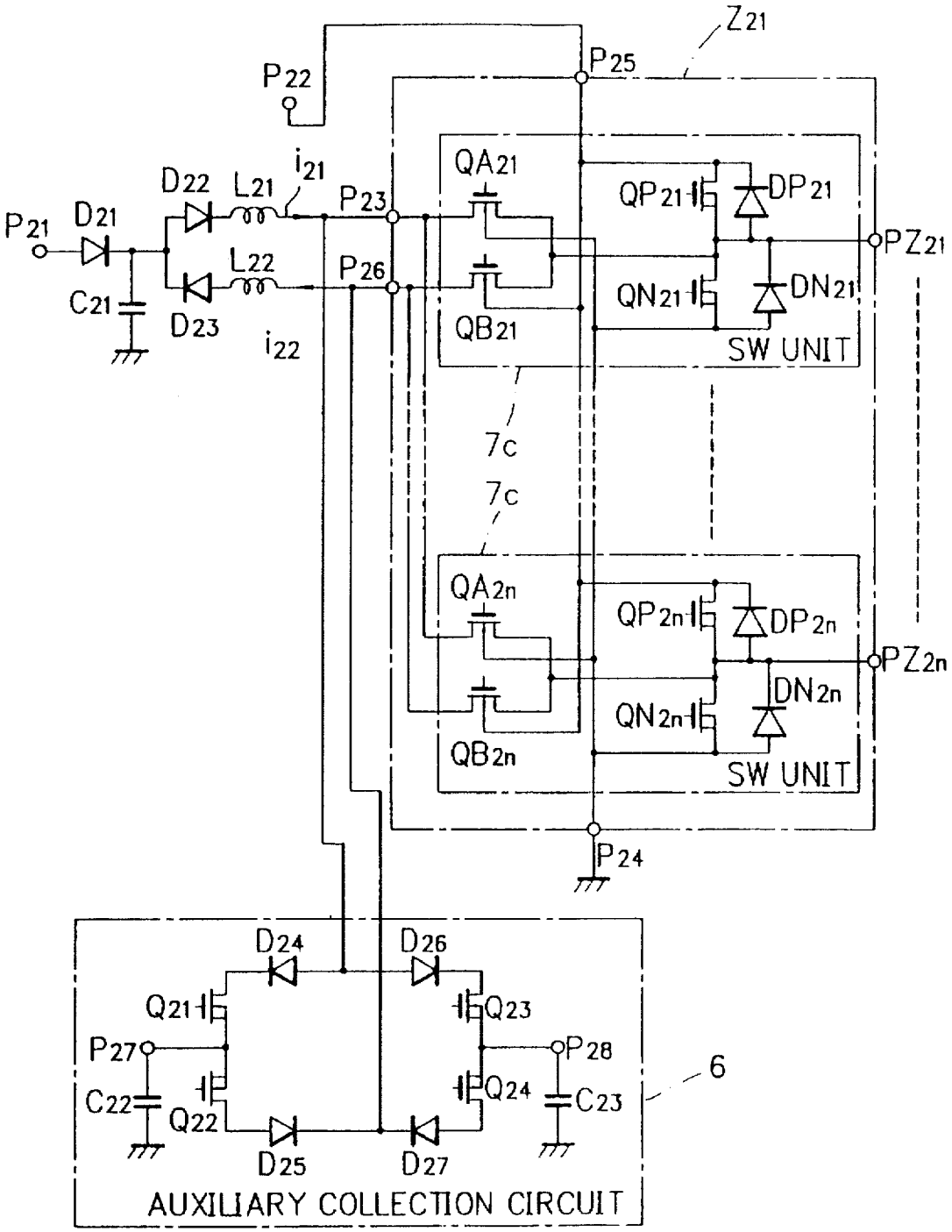
FIG. 9 is a diagram showing structure of a third embodiment in accordance with the present invention.

FIG. 9 shows constitution of the third embodiment of the driver circuit in which consecutive data pulses and charge collection are cooperatively employed to enhance the power saving effect in accordance with the present invention.

Referring to FIG. 9, $Z_{21}$ indicates an integrated circuit (IC) resistive against a high voltage to drive column electrodes. $P_{21}$ is a terminal to apply a dc voltage for charge collection which is about one half of data voltage Vd. $P_{22}$ denotes a terminal to apply a dc voltage of data voltage Vd, $P_{23}$ represents a first terminal for charge collection of IC $Z_{21}$, $P_{24}$ is a ground terminal of IC $Z_{21}$, $P_{25}$ is a terminal to input data voltage Vd, $P_{26}$ is a second terminal for charge collection of IC $Z_{21}$; $D_{21}$ to $D_{27}$ are diodes, $C_{21}$ is a charge collecting capacitor having an electrostatic capacity which is at least about 100 times the composite column electrostatic capacity of the column electrodes for charge collection and auxiliary capacitors, $C_{22}$ and $C_{23}$ are auxiliary capacitors (having an electrostatic capacity of 4 nF) to minimize the variation rate of the collected electrostatic capacity due to the change in the electrostatic capacity of the column electrodes for charge collection. designates a coil (having an inductance of 1 μH) for charge collection on the column electrode charging side, $L_{22}$ is a coil (having an inductance of 1 μH) for charge collection on the column electrode discharging side, $Q_{21}$ and $Q_{23}$ are n-channel FETs, $Q_{22}$ and $Q_{24}$ denote p-channel FETs; $QA_{21}$, . . . , $QA_{2n}$ are n-channel transfer gates resistive against a high voltage in IC $Z_{21}$; $QB_{21}$, . . . , $QB_{2n}$ indicate p-channel transfer gates resistive against a high voltage in IC $Z_{21}$;, $QN_{21}$, . . . , $QN_{2n}$ are n-channel FETs resistive against a high voltage in IC $Z_{21}$; $QP_{21}$, . . . , $QP_{2n}$ stand for p-channel FETs resistive against a high voltage in IC $Z_{21}$; $DN_{21}$, . . . , $DN_{2n}$ denote parasitic diodes repectively of n-channel FETs $QN_{21}$, . . . , $QN_{2n}$; $DP_{21}$, . . . , $DP_{2n}$ stand for parasitic diodes respectively of p-channel FETs $QP_{21}$, . . . , $QP_{2n}$; $PZ_{21}$, . . . , $PZ_{2n}$ indicates output terminals of IC $Z_{21}$ to be connected to the respective column electrodes, and 7c is a switching unit including FETs $QP_{2i}$ and $QN_{2i}$, parasitic diodes $DP_{2i}$ and $DN_{2i}$ and transfer gates $QA_{2i}$ and $QB_{2i}$ (i=1 to n).

FIG. 10 shows in a graph waveforms of voltages and currents of the circuit in accordance with the embodiment. In the graph, periods $T_{21}$, $T_{23}$, and $T_{25}$ are transition periods to turn data pulses on or off, and periods $T_{22}$ and $T_{24}$ are utilized to clamp data pulses to a fixed voltage.

The system of FIG. 9 includes an auxiliary collection circuit 6 to achieve, even when the unmber of columns selected for charge collection (or columns to be set again to the zero potential) is small, the charge collection in a manner similar to that use in a case where the number of such columns is large.

First, description will be given of the principle of operation of the auxiliary collection circuit 6.

When comparing waveform (E) at terminal $P_{27}$ with waveform (H) at terminal $P_{28}$ shown in FIG. 10, when either one thereof makes transition from a low-voltage state to a high-voltage state, the other one thereof changes its state in the opposite direction. Through the operation, auxiliary capacitors $C_{22}$ and $C_{23}$ serve respectively as charging and discharging elements or vice versa during transition periods $T_{21}$, $T_{23}$, and $T_{25}$.

As a result, the variation rate of electrostatic capacity related to charge collection is mitigated in relation to variation in the number of column electrodes to be charged or discharged. Incidentally, two auxiliary capacitors are required because the charge and discharge operations of the respective column electrodes are simultaneously accomplished during transition periods $T_{21}$, $T_{23}$, and $T_{25}$.

Subsequently, description will be given of a specific operation of the auxiliary collection circuit 6.

FET $Q_{21}$, is first set to a conductive state in period $T_{21}$ such that electric charge stored in collection capacitor $C_{21}$ is transferred via diode $D_{22}$, coil $L_{21}$, diode $D_{24}$, and FET $Q_{21}$ to auxiliary capacitor $C_{22}$. The voltage at terminal $P_{27}$ is shown as that of auxiliary capacitor $C_{22}$ in (E) of FIG. 10.

During period $T_{21}$, FET $Q_{24}$ becomes conductive to flow charge from auxiliary capacitor $C_{23}$ via FET $Q_{24}$, diode $D_{27}$, coil $L_{22}$, and diode $D_{23}$ into collection capacitor $C_{21}$. The voltage at terminal $P_{28}$ is presented as that of auxiliary capacitor $C_{23}$ in (H) of FIG. 10.

Next, during period $T_{23}$, FET $Q_{23}$ is conductive to pass charge from auxiliary capacitor $C_{21}$ via diode $D_{22}$, coil $L_{26}$, diode $D_{26}$, and FET $Q_{23}$ into collection capacitor $C_{23}$. The voltage of terminal $P_{28}$ is shown as that of auxiliary capacitor $C_{23}$ in (H) of FIG. 10.

Moreover, FET $Q_{22}$ is set to a conductive state in period $T_{23}$ such that electric charge kept in collection capacitor $C_{22}$ is sent via FET $Q_{22}$, diode $D_{25}$, coil $L_{22}$, and diode $D_{23}$ to auxiliary capacitor $C_{21}$. The voltage developed at terminal $P_{27}$ is shown as that of auxiliary capacitor $C_{22}$ in (E) of FIG. 10.

Referring next to an example of the voltage waveform at output terminal $PZ_{21}$, description will be given of operation of a circuit to apply data pulses to column electrodes.

In period $T_{21}$, since no data pulse has been applied to column electrodes therebefore, the voltage of terminal $PZ_{21}$ linked to column electrodes to be applied with data pulses after period $T_{21}$ is raised as shown in (K) of FIG. 10.

For this purpose, transfer gate $QA_{21}$, is set to a conductive state to flow charge from collection capacitor $C_{21}$ via diode $D_{22}$, coil $L_{21}$, transfer gate $QA_{21}$, and terminal $PZ_{21}$ so as to charge the pertinent column electrode.

During period $T_{22}$, n-channel FET $QN_{21}$ is turned off and p-channel FET $QP_{21}$ is turned on in IC $Z_{21}$ to clamp the voltage of data pulses to data voltage Vd. In this connection, since FETs $QP_{2i}$ and $QN_{2i}$ operate mutually in a complementary fashion, when $QP_{2i}$ is on (off), $QN_{2i}$ is off (on) except transition periods $T_{21}$, $T_{23}$, and $T_{25}$.

In period $T_{23}$, the pulse voltage is kept unchanged at terminal $PZ_{21}$. Therefore, transfer gates $QA_{21}$ and $QB_{21}$ are kept closed and FETs $QP_{21}$ and $QN_{21}$ are in the on and off states respectively.

Also during $T_{24}$, since the voltage of $PZ_{21}$ is at data voltage Vd, the states of transfer gates $QA_{21}$ and $QB_{21}$ and FETs $QP_{21}$ and $QN_{21}$ are unchanged.

In period $T_{25}$, since data pulses have already applied to column electrodes before period $T_{25}$, the voltage of terminal $PZ_{21}$ coupled with a column electrode from which data pulses are to be removed after period $T_{25}$ is lowered (FIG. 10 (K)). To achieve this operation, transfer gate $QB_{21}$ is made to be conductive such that the change kept in the selected column electrode is transferred via terminal $PZ_{21}$, transfer gate $QB_{21}$, coil $L_{22}$, and diode $D_{23}$ to be gathered in the collection capacitor $C_{21}$.

Each of periods $T_{21}$, $T_{23}$, and $T_{25}$ is set to about 0.31 μs, namely, the rising or falling time of the pertinent data pulse.

In the third embodiment described above, the power saving effect of data pulses can be remarkably improved by cooperatively using successive data pulses and charge collection. Additionally, since the on and off transitions of the respective column electrodes occur in the same period, the period of time necessary for the state transitions can be decreased. resulting in a high-speed operation.

Incidentally, when there is required only a simple operation, the auxiliary collection circuit 6 may be omitted.

Figure 11:
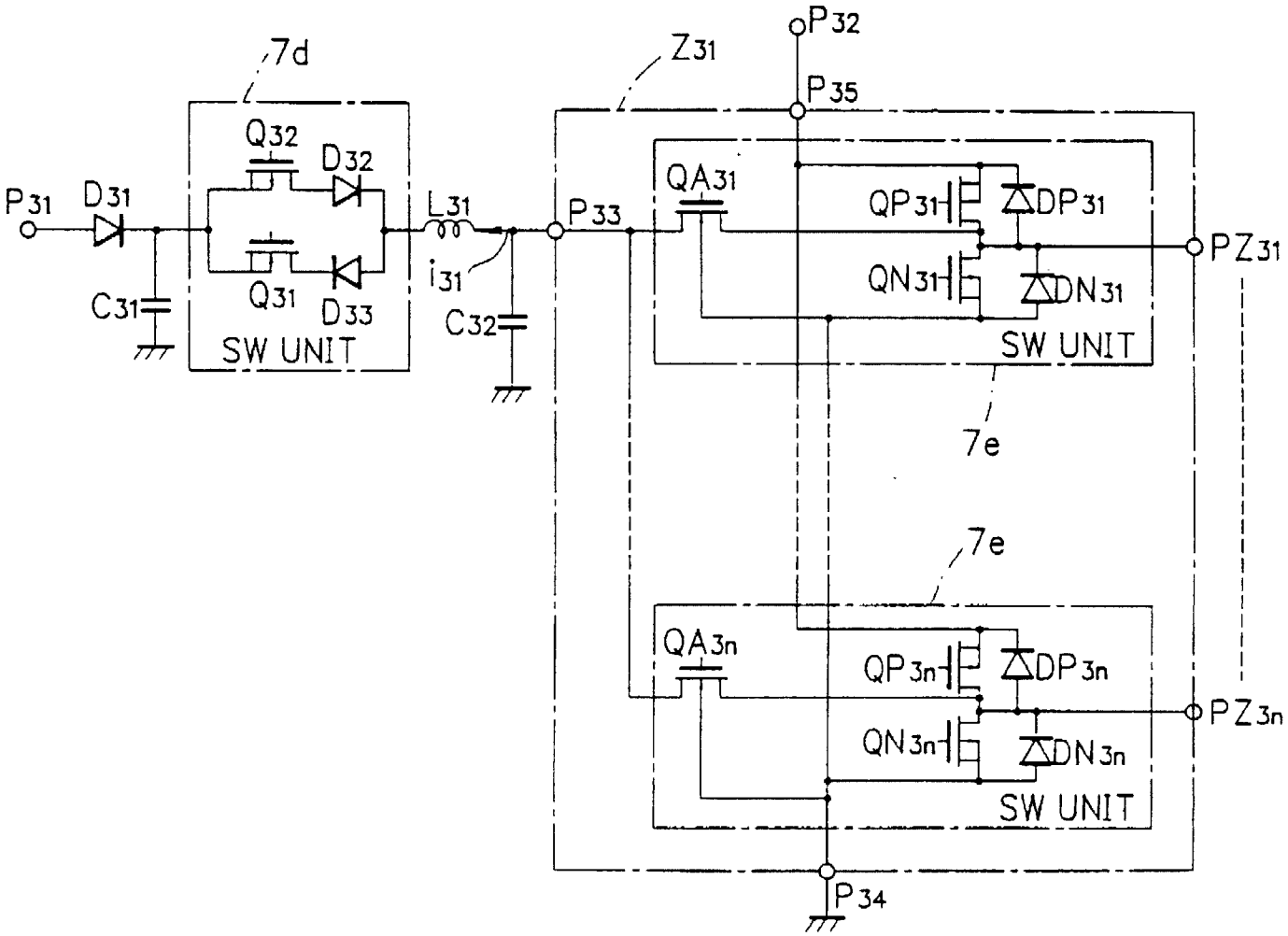
FIG. 11 is a diagram showing the configuration of a fourth embodiment in accordance with the present invention.

FIG. 11 shows the configuration of a fourth embodiment of the driver circuit implemented in accordance with the present invention by simplifying the charge collection circuit of the third embodiment described above.

In the circuit configuration of FIG. 11, $Z_{31}$ indicates an IC resistive against a high voltage to drive column electrodes, $P_{31}$ is a terminal to apply a dc voltage for charge collection which is about one half of data voltage Vd for charge collection, $P_{32}$ denotes a terminal to apply a dc voltage of data voltage Vd, $P_{33}$ stands for a terminal for charge collection of IC $Z_{31}$, $P_{34}$ designates a ground terminal of IC $Z_{31}$, $P_{35}$ is a terminal to input data voltage Vd to IC $Z_{31}$; $D_{31}$ to $D_{33}$ are diodes, $C_{31}$ indicates a charge collecting capacitor having an electrostatic capacity which is at least about 100 times the composite electrostatic capacity of column electrodes for charge collection and auxiliary capacitors, $C_{32}$ denotes an auxiliary capacitor (having an electrostatic capacity of 4 nF) to decrease the variation rate of the collected electrostatic capacity due to change in the electrostatic capacity of the column electrodes for charge collection, $L_{31}$ is a coil (having an inductance of 1 μH) for charge collection, $Q_{31}$ is an n-channel FET, $Q_{32}$ indicates a p-channel FET; $QA_{31}, \ldots, QA_{3n}$ are n-channel transfer gates resistive against a high voltage in IC $Z_{31}$; $QN_{31}, \ldots, QN_{3n}$ are n-channel FETs resistive against a high voltage in IC $Z_{31}$; $QP_{31}, \ldots, QP_{3n}$ indicate p-channel FETs resistive against a high voltage in IC $Z_{31}$; $DN_{31}, \ldots, DN_{3n}$ are parasitic diodes respectively of n-channel FETs $QN_{31}, \ldots, QN_{3n}$ $DP_{31}, \ldots, DP_{3n}$ stand for parasitic diodes respectively of p-channel FETs $QP_{31}, \ldots, QP_{3n}$; $PZ_{31}, \ldots, PZ_{3n}$ are output terminals of IC $Z_{31}$ linked with the respective column electrodes, *7d* indicates a switching unit including FETs $Q_{31}$ and $Q_{32}$ and diodes $D_{32}$ and $D_{33}$; and *7e* designates a switching unit inluding FETs $QP_{3i}$ and $QN_{3i}$, parasitic diodes $DP_{3i}$ and $DN_{3i}$, and transfer gates $QA_3i$ (i=1 to n).

Figure 12:
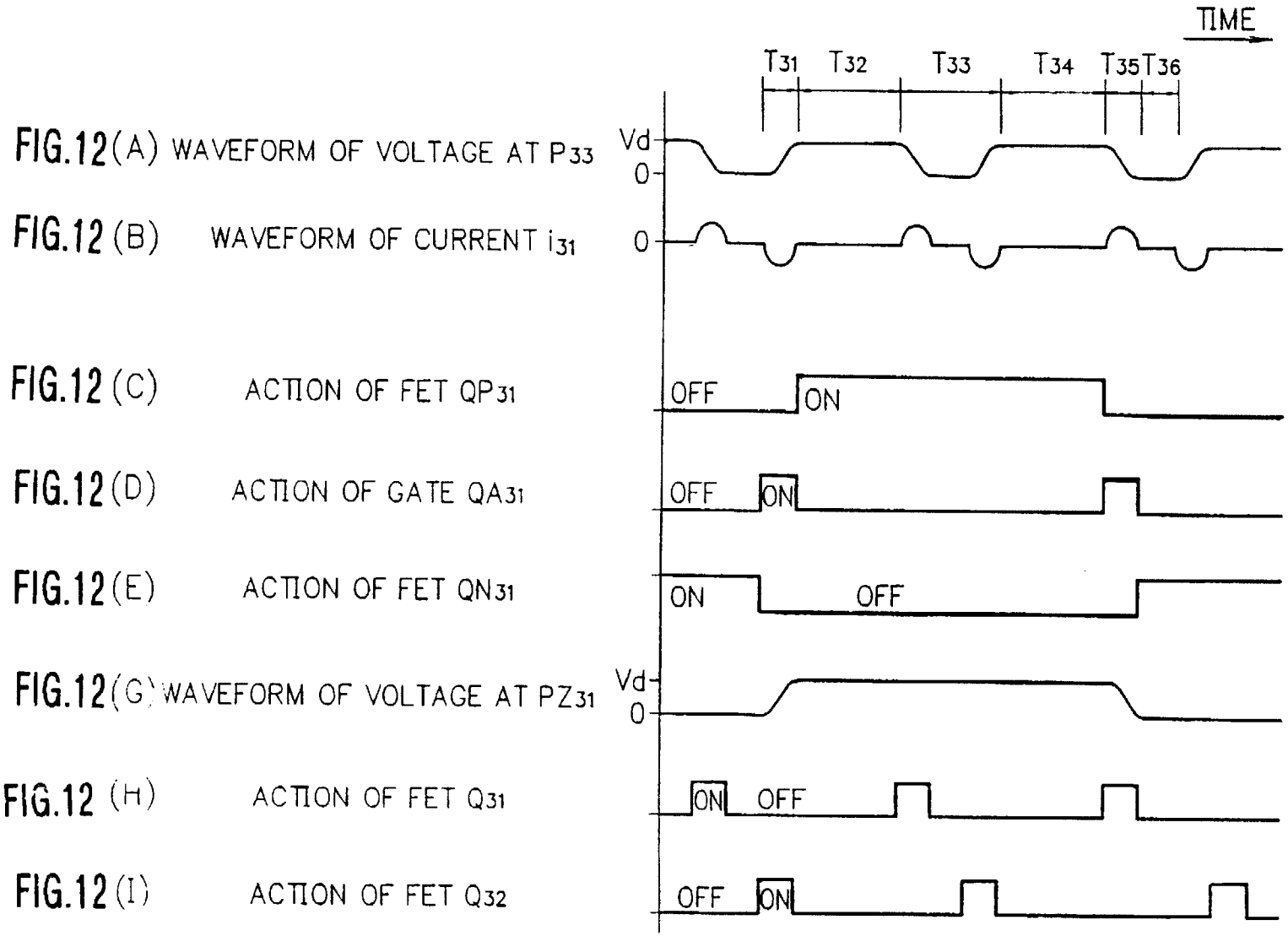
FIG. 12 is a graph showing operation waveforms of the fourth embodiment in accordance with the present invention.

FIG. 12 shows waveforms of voltages and currents of the circuit in accordance with the fourth embodiment.

In FIG. 12, periods $T_{31}$, $T_{33}$, $T_{35}$, and $T_{36}$ are transition periods to turn data pulses on or off, whereas periods $T_{32}$ and $T_{34}$ are used to clamp data pulses to a constant voltage.

Subsequently, referring to voltage waveform (G) of FIG. 12 at output terminal $PZ_{31}$, description will be given of an operation to apply data pulses to column electrodes.

In period $T_{31}$, since no data pulse has been applied to column electrodes therebefore, the voltage of terminal $PZ_{31}$ coupled with a column electrode to be applied with data pulses after period $T_{31}$ is increased as shown in (G) of FIG. 12. For this operation, FET $Q_{32}$ and transfer gate $QA_{21}$ are set to a conductive state to pass charge from collection capacitor $C_{31}$ via FET $Q_{32}$, diode $D_{32}$, coil $L_{31}$, transfer gate $QA_{31}$, and terminal $PZ_{31}$ to the associated column electrode.

During period $T_{32}$, n-channel FET $QN_{31}$ is turned off and p-channel FET $QP_3$, is turned on in IC $Z_{31}$ to clamp the voltage of data pulses to data voltage Vd. Incidentally, since FETs $QP_{31}$ and $QN_{3i}$ operate mutually in a complementary fashion, $QN_{3i}$ is off (on) when $QP_{3i}$ is on (off) except the transition periods $T_{31}$, $T_{33}$, $T_{35}$, and $T_{36}$.

In period $T_{33}$, since there exists the next data pulse, the pulse voltage is unchanged at terminal $PZ_{31}$. Therefore, transfer gate $QA_{31}$ is kept closed and FETs $QP_{31}$ and $QN_{31}$ are retained in the on and off states respectively.

Also during $T_{34}$, the voltage of $PZ_{31}$ is at data voltage Vd and hence the states of transfer gate $QA_{31}$ and FETs $QP_{31}$ and $QN_{31}$ are unchanged.

In period $T_{35}$, since data pulses have already been applied to column electrodes prior to period $T_{35}$, the voltage of terminal $PZ_{31}$ coupled with column electrodes from which data pulses are to be removed after period $T_{35}$ is reduced (FIG. 12 (G)). To accomplish this operation, transfer gate $QA_{31}$ is made to be conductive such that charge stored in the column electrodes is transferred via terminal $PZ_{31}$, transfer gate $QA_{31}$, coil $L_{31}$, diode $D_{33}$, and FET $Q_{31}$ to the collection capacitor $C_{31}$.

Each of periods $T_{31}$ and $T_{35}$ is set to about 0.31 μs, which is the rising or falling time of the pertinent data pulse. Period $T_{36}$ provided to establish points of timing of charge and discharge operations is set to a value ranging from 0 μs to 0.1 μs.

In the fourth embodiment, capacitor $C_{32}$ may be dispensed with like in the second embodiment.

As above, in accordance with the fourth embodiment, the power saving effect of data pulses can be considerably improved thanks to the cooperative utilization of successive data pulses and charge collection. In this case, unlike in the third embodiment, it is impossible that the on and off transitions of the respective column electrodes take place in the same period. Therefore, the period of time necessary for the state transitions is about twice that of the third embodiment. However, the fourth embodiment leads to an advantage that the charge collection circuit and IC $Z_{31}$ can be constructed in a simple configuration.

Figure 13:
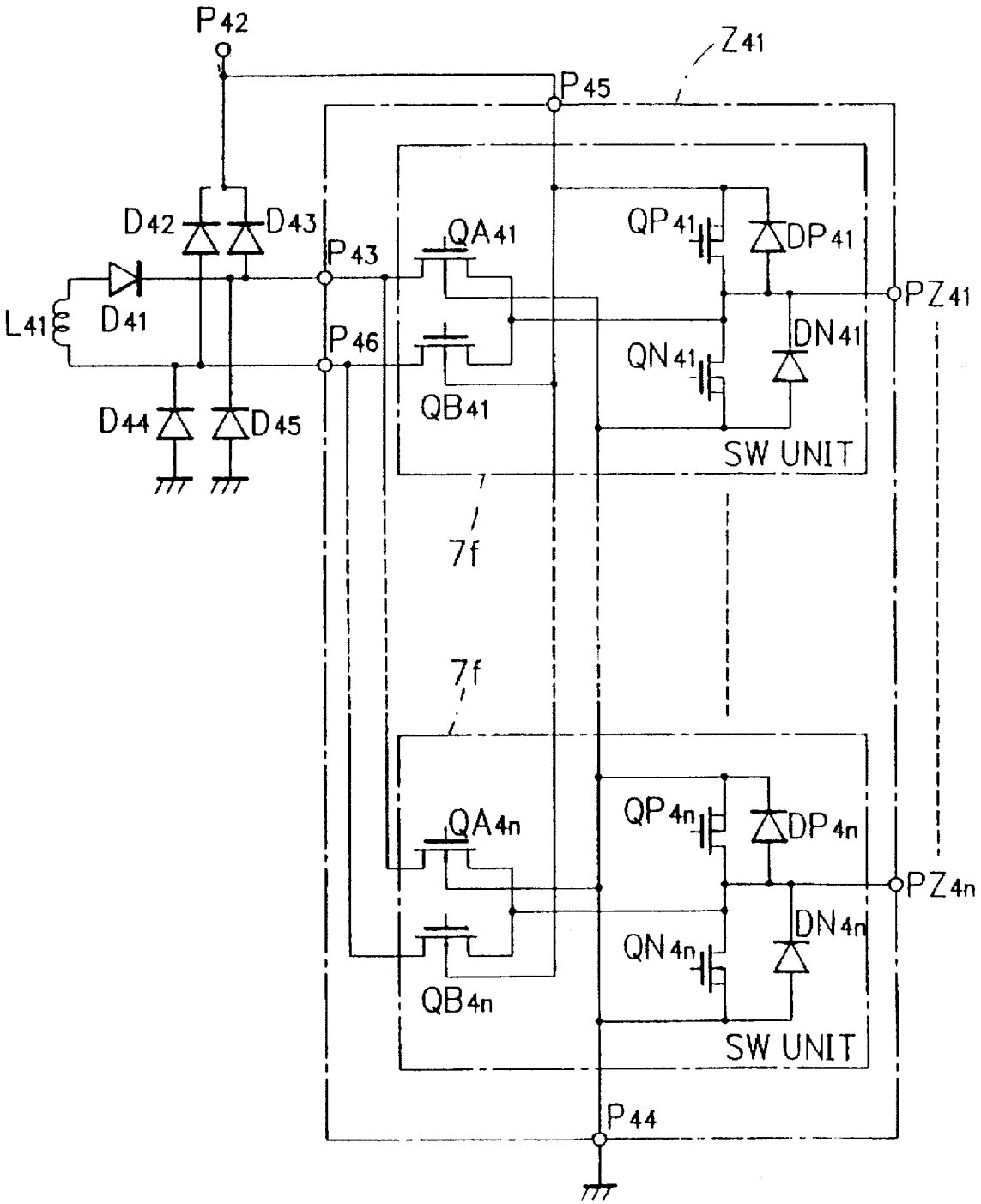
FIG. 13 is a diagram showing constitution of a fifth embodiment in accordance with the present invention.

FIG. 13 shows structure of a fifth embodiment of the driver circuit implemented in accordance with the present invention by simplifying the circuit other than IC $Z_{21}$ of the third embodiment (FIG. 9) capable of remarkably improving the power saving effect of data pulses by cooperatively employing consecutive data pulses and charge collection.

Referring now to the circuit of FIG. 13, $Z_{41}$ indicates an IC resistive against a high voltage to drive column electrodes, $P_{42}$ denotes a terminal to apply a dc voltage of data voltage Vd, $P_{43}$ is a first terminal for charge collection of IC $Z_{41}$, $P_{44}$ designates a ground terminal of IC $Z_{41}$, $P_{45}$ is a terminal to input data voltage Vd to IC $Z_{41}$, $P_{46}$ is a second terminal for charge collection of IC $Z_{41}$, $D_{41}$ to $D_{45}$ are diodes. $L_{41}$ indicates a coil (having an inductance of 1 μH) for charge collection, $QA_{41}, \ldots, QA_{4n}$ are n-channel transfer gates resistive against a high voltage in IC $Z_{41}$; $QB_{41}, \ldots, QB_{4n}$ are p-channel transfer gates resistive against a high voltage in IC $Z_{41}$; $QN_{41}, \ldots, QN_{4n}$ stand for n-channel FETs resistive against a high voltage in IC $Z_{41}$; $QP_{41}, \ldots, QP_{4n}$ are p-channel FETs resistive against a high voltage in IC $Z_{41}$; $DN_{41}, \ldots, DN_{4n}$ indicate parasitic diodes respectively of n-channel FETs $QN_{41}, \ldots, QN_{4n}$; $DP_{41}, \ldots, DP_{4n}$ are parasitic diodes respectively of p-channel FETs $QP_{41}, \ldots, QP_{4n}$; $PZ_{41}, \ldots, PZ_{4n}$ represent output terminals of IC $Z_{41}$ linked with the respective column electrodes, and *7f* denotes a switching unit including FETs $QP_{4i}$ and $QN_{4i}$ parasitic diodes $DP_{4i}$ and $DN_{4i}$ and transfer gates $QA_{4i}$ and $QB_{4i}$ (i=1 to n).

FIG. 14 shows waveforms of voltages and currents of the circuit in accordance with the fifth embodiment.

In FIG. 14, periods $T_{41}$, $T_{43}$, and $T_{45}$ are transition periods to turn data pulses on or off and periods $T_{42}$, and $T_{44}$ are employed to clamp data pulses to a fixed voltage.

Next, referring to the voltage waveform at output terminal $PZ_{41}$, description will be given of an operation to apply data pulses to column electrodes.

During period $T_{41}$, no data pulse has been applied to column electrodes therebefore and hence the voltage of terminal $PZ_{41}$ coupled with column electrodes to be applied with data pulses after period $T_{41}$ is increased (reference to be made to (c) of FIG. 14). For this purpose, transfer gate $QA_{41}$ is set to a conductive state. As a result, the voltage of terminal $P_{43}$ is once decreased down to a minimum potential level as shown in (A) of FIG. 14.

In concurrence therewith, during period $T_{41}$, since data pulses have been applied to column electrodes therebefore, the voltage to each terminals $PZ_{41}$ (i ranges from 2 to n and indicates a number assigned to a terminal from which the data pulse is to be removed) coupled with column electrodes from which data pulses are to be removed after period $T_{41}$ is decreased (reference is to be made to (H) of FIG. 14). To achieve this operation, transfer gate $QB_{4i}$ (i ranges from 2 to n and indicates a number assigned to a terminal from which the data pulse is to be removed) is made to be conductive. Resultantly, the voltage of terminal $P_{46}$ is once increased up to a value near data voltage Vd as shown in (B) of FIG. 14.

In consequence, at the initiating point of period $T_{41}$, there takes place a potential difference of about Vd between terminals $P_{43}$ and $P_{46}$. Therefore, a current flows from terminal $P_{46}$ through coil $L_{41}$ and diode $D_{41}$ to terminal $P_{43}$ such that the potential levels respectively of terminals $P_{43}$ and $P_{46}$ are reversed ((A) and (B) of FIG. 14).

During period $T_{42}$, n-channel FET $QN_{41}$ and p-channel FET $QP_{41}$ of IC $Z_{41}$ are respectively turned off and on to clamp the voltage of data pulses to data voltage Vd. In this regard, FETs $QP_{4i}$ and $QN_{4i}$ operate mutually in a complementary fashion. Consequently, when $QP_{4i}$ is on (off), $QN_{31}$ is off (on) except transition periods $T_{41}$, $T_{43}$, and $T_{45}$.

In period $T_{43}$, the pulse voltage at terminal $PZ_{41}$ is unchanged. Therefore, transfer gates $QA_{41}$ and $QB_{41}$ are kept closed, whereas FETs $QP_{41}$ and $QN_{41}$ are retained in the on and off states, respectively.

Also during period $T_{44}$, the voltage of $PZ_{41}$ is kept at data voltage Vd and hence the states of transfer gates $QA_{41}$ and $QB_{41}$ and FETs $QP_{41}$ and $QN_{41}$ are unchanged.

In period $T_{45}$, data pulses have already been applied to column electrodes prior to period $T_{45}$. Consequently, the voltage at terminal $PZ_{41}$ linked with a column electrode from which data pulses are to be removed after period $T_{45}$ is minimized ((C) of FIG. 14). To accomplish the operation, transfer gate $QB_{41}$ is made to be conductive such that charge stored in the selected column electrodes is sent via terminal $PZ_{41}$, transfer gate $QB_{41}$, coil $L_{41}$, and diode $D_{41}$ to column electrodes to which pulses are to be applied.

Each of periods $T_{41}$, $T_{43}$, and $T_{45}$ is set to about 0.31 μs, namely, the rising or falling time of the pertinent data pulse.

In accordance with the fifth embodiment described above, it is possible to remarkably improve the power saving effect of data pulses by cooperatively employing successive data pulses and charge collection. In addition, since the on and off transitions of the respective column electrodes occur in the same period, the period of time necessary for the state transitions is reduced and the operation speed is accordingly increased.

When compared with the third embodiment, the fifth embodiment requires a decreased number of parts to be externally connected to the integrated circuit to drive the column electrodes. Furthermore, thses parts are passive elements and hence control signals are unnecessary, which leads to an advantage that the circuit can be considerably simplified. However, in case where the relationship between the number of column electrodes to be applied data pulses and that of column electrodes from which data pulses are to be removed is not satisfactorily balanced, the charge collecting ratio may possibly be decreased in some cases.

Although description has been given of the embodiments with numeric values thereof, these values have been used only be way of example to explain the present invention and hence the present invention is not restricted by the values.

Figure 1:
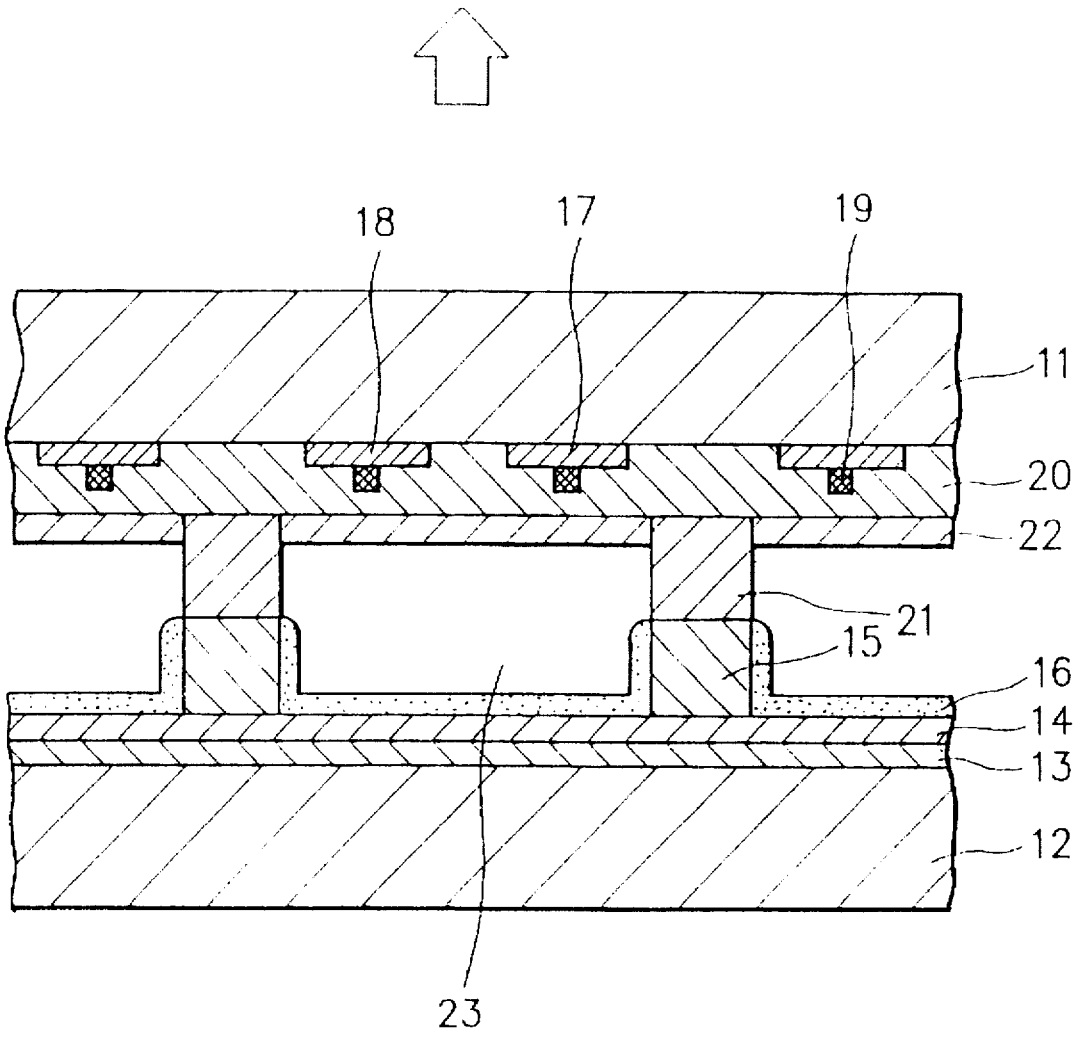
FIG. 1 PRIOR ART
FIG. 1 is a diagram schematically showing constitution of a conventional plasma display panel of an alternating current (ac) planar discharge type.

In the description the embodiments in accordance with the present invention, a plasma display panel configured as shown in FIGS. 1 and 2 is employed by way of example. However, the present invention is not restricted by the plasma display panel of the construction but is naturally applicable to the driving of plasma display panels of other ac and dc types. Furthermore, the present invention is applicable to the driving of, in addition to plasma display panels, other capacitive display panels such as electroluminescent panels and liquid crystal panels.

Additionally, in the description of embodiments described above, an FET is adopted as a switch resistive against a high voltage. However, there may also be employed, for example, a bipolar transister, in place of the FET for the switch.

The present invention has been described in conjunction with the embodiments thereof. However, the present invention is not restricted only by the embodiments. It is to be appreciated that any embodiments in accordance with the principle of the present invention is included in the scope of the present invention.

As described above, in accordance with the present invention (claim 1), power of data pulses applied to capacitive column electrodes can be efficiently minimized. Consequently, the present invention is quite valuable in industrial fields. The effect is favorably achieved when the claims 2 to 4 are additionally implemented.

Furthermore, in accordance with the present invention (claim 6), at a predetermined period of time after initiation of operation of the charge collection circuit, when the voltage of the data voltage input terminal of the circuit takes a value equal to or less than a predetermined level or takes a minimum, value, the FETs of the IC to drive column electrodes are turn on or off. Consequently, the charge collecting efficiency is maximized and the supply of data voltage from the data power to the IC can be controlled to optimize the charge collecting efficiency.

Moreover, in accordance with the present invention (claim 8), when compared with the prior art in which the switch to control a large current is controlled at a precise timing, such an exact timing control operation is unnecessary in accordance with the present invention. That is, there can be implemented a driver circuit which develops a high charge collecting efficiency on the data side while controlling the on or off transitions of the FETs at fixed points of timing. Additionally, in accordance with the present invention (claim 8), even when falling or rising time T of data pulses becomes small, the circuit operation is carried out without any problem. Consequently, the auxiliary capacitor may be dispensed with.

In addition, in accordance with the present invention (claim 10), the power saving effect of data pulses can be remarkably increased thanks to the cooperative adoption of consecutive data pulses and charge collection. Moreover, since the on or off transitions of the respective column electrodes take place in the same period, the period of time necessary for the state transition is minimized and hence the operation can be accomplished at a high speed.

Furthermore, in accordance with the present invention (claim 8), the power saving effect of data pulses can be remarkably improved owing to the cooperative usage of consecutive data pulses and charge collection. In this case, it is impossible that the on or off transitions of the respective column electrodes take place in the same period. Consequently, although the period of time necessary for the state transition is elongated, there is attained an advantage that the charge collection circuit and the integrated circuit to drive column electrodes can be configured in a simple fashion.

Additionally, in accordance with the present invention (claim 10), the power saving effect of data pulses can be remarkably increased through the cooperative adoption of consecutive data pulses and charge collection. Furthermore, the on or off transitions of the respective column electrodes take place in the same period and hence the period of time necessary for the state transition is minimized, which leads to a high-speed operation of the system. In addition, the number of parts externally added to the integrated circuit to drive column electrodes is lowered in accordance with the present invention, and the parts are substantially passive elements not requiring any particular control signals. This results in an advantage that the circuit configuration is considerably simplified.

While the present invention has been described with reference to the particular illustrative embodiments, it is not to be restricted by those embodiments but only by the appended claims. It is to be appreciated that those skilled in the art can change or modify the embodiments without departing from the scope and spirit of the present invention.

What is claimed is:

1. A driver circuit for applying data pulses to column electrodes of a display panel which at least includes a plurality of row electrodes formed in a plane in parallel to each other and a plurality of column electrodes formed to be isolated from the row electrodes, parallel to each other, and orthogonal to the row electrodes, the driver circuit including a circuit for collecting charge of data pulses, wherein in the charge collecting circuit;

a data voltage input terminal supplying a data voltage to an integrated circuit (IC) to drive the column electrodes is commonly connected to a terminal of a switch having another terminal connected to a data voltage source, an auxiliary capacitor having another end connected to a ground potential, and a terminal of a coil, the coil having another terminal connected to a terminal of a switching unit which controls a current to collect charge in a charge collecting capacitor and which passes a current to supply charge to the column electrodes of the display panel, the switching unit having another terminal connected to a voltage source of about one half of the data voltage and a terminal of the charge collecting capacitor having another terminal connected to a ground potential.

2. A driver circuit for a display panel in accordance with claim 1 wherein:

when charge stored in the column electrodes of the display panel and the auxiliary capacitor is collected in the charge collecting capacitor and hence the data voltage input terminal is lowered to a predetermined potential level, there is conducted an operation to control an on or off transition of transistors in the IC; and when the current to charge the column electrodes of the display panel charges the auxiliary capacitor and hence potential of the data input terminal is increased to be substantially equal to the data voltage, there is conducted a control operation to supply the data voltage from the data power source to the IC.

3. A driver circuit for applying data pulses to column electrodes of a display panel which at least includes a plurality of row electrodes formed in a plane in parallel to each other and a plurality of column electrodes formed to be isolated from the row electrodes, parallel to each other, and orthogonal to the row electrodes, the driver circuit including a circuit for collecting charge of data pulses, wherein the charge collecting circuit comprises:

a capacitor for collecting charge therein and an auxiliary capacitor, switching means arranged between a terminal of the charge collecting capacitor and a data voltage input terminal supplying data voltage to an integrated circuit (IC) to drive the column electrodes, the switching means controlling a current in a direction in which charge is collected and passing therethrough a current in a direction in which charge is supplied to the column electrodes of the display panel, the auxiliary capacitor being connected between the data voltage input terminal and a ground potential, the charge collecting capacitor having another terminal connected to a ground potential, a differentiater circuit connected to the data voltage input terminal and a comparator for transforming an output from the differentiater circuit into a digital signal, and operation timing of switches which is resistive against a high voltage and disposed in the IC to drives the column electrodes and a switch having a terminal connected to a coil and another terminal connected to the data voltage source being controlled in response to pulses produced from the comparator.

4. A driver circuit for applying data pulses to column electrodes of a display panel which at least includes a plurality of row electrodes formed in a plane in parallel to each other and a plurality of column electrodes formed to be isolated from the row electrodes, parallel to each other, and orthogonal to the row electrodes, the driver circuit including a circuit for collecting charge of data pulses, wherein:

the charge collecting circuit comprises at least a capacitor for collecting charge therein, a data input terminal to supply a data voltage to an integrated circuit (IC) to drive the column electrodes being connected to a terminal of a coil for collecting charge and a terminal of a switch having another terminal connected to a data voltage source, a first switch and a second switch respectively controlling a current flowing from a side of the coil to the charge collecting capacitor and a current flowing from the charge collecting capacitor to the side of the coil, being connected between another end of the coil and an end of the charge collecting capacitor, the charge collecting capacitor having a terminal connected to a voltage source of about one half of the data voltage and another terminal connected to a ground potential.

5. A driver circuit for a display panel in accordance with claim 4, further including an auxiliary capacitor connected between the data voltage input terminal of the IC to drive the column electrodes and a ground potential.

6. A driver circuit for applying data pulses to column electrodes of a display panel which at least includes a plurality of row electrodes formed in a plane in parallel to each other and a plurality of column electrodes formed to be isolated from the row electrodes, parallel to each other, and orthogonal to the row electrodes, the driver circuit including a circuit for collecting charge of data pulses, wherein the charge collecting circuit:

an integrated circuit (IC) to drive the column electrodes and includes at least one switching unit, the at least one switching unit including:

a first switch connected between a data voltage input terminal to supply a data voltage to the IC and an output terminal, a second switch connected between the output terminal and a ground terminal in the IC, a third switch having a terminal connected to the output terminal and another terminal connected to a first charge collecting terminal, a fourth switch having a terminal connected to the output terminal and another terminal connected to a second charge collecting terminal, the data voltage input terminal being connected to a data voltage source, a first charge collecting terminal being connected to a terminal of a first coil having another terminal connected to a cathode of a first diode, the second charge collecting terminal being connected to a terminal of a second coil having another terminal connected to an anode of a second diode, and an anode and a cathode respectively of the first and second diodes are commonly connected to each other to be connected to a terminal of a charge collecting capacitor having another terminal connected to a ground potential, the commonly connected point of the anode and the cathode being connected to a voltage source of substantially one half of the data voltage.

7. A driver circuit for a display panel in accordance with claim 6, further including an auxiliary charge collecting circuit, wherein in the auxiliary charge collecting circuit:

the first charge collecting terminal is connected to a terminal of each of first and second charge collecting capacitors via the first and second diodes and the first and second switches; and a terminal each of the first and second charge collecting capacitors is connected to the second charge collecting terminal via the third and fourth switches and third and fourth diodes.

8. A driver circuit for applying data pulses to column electrodes of a display panel which at least includes a plurality of row electrodes formed in a plane in parallel to each other and a plurality of column electrodes formed to be isolated from the row electrodes, parallel to each other, and orthogonal to the row electrodes, the driver circuit including a circuit for collecting charge of data pulses, wherein in the charge collecting circuit:

an integrated circuit (IC) to drive the column electrodes and includes at least one switching unit, the at least one switching unit including:

a first switch connected between a data voltage input terminal to supply a data voltage to the IC and an output terminal, a second switch connected between the output terminal and a ground terminal in the IC, a third switch having a terminal connected to the output terminal and another terminal connected to a charge collecting terminal, the data voltage input terminal of the IC to drive the column electrodes being connected to a data voltage source, the charge collecting terminal being connected to a terminal of a coil having another terminal connected to a cathode point of an additional switching unit controlling currents respectively flowing from and into the coil, and another contact point of the switching unit being commonly connected the second charge collecting terminal being commonly connected to a terminal of a charge collecting capacitor having another terminal grounded and to a voltage source of substantially one half of the data voltage.

9. A driver circuit for a display panel in accordance with claim 8, further including an auxiliary capacitor connected between the charge collecting terminal and a ground potential.

10. A driver circuit for applying data pulses to column electrodes of a display panel which at least includes a plurality of row electrodes formed in a plane in parallel to each other and a plurality of column electrodes formed to be isolated from the row electrodes, parallel to each other, and orthogonal to the row electrodes, the driver circuit including a circuit for collecting charge of data pulses, wherein the charge collecting circuit:

an integrated circuit (IC) to drive the column electrodes and includes at least one switching unit, the at least one switching unit including:

a first switch connected between a data voltage input terminal to supply a data voltage to the IC and an output terminal, a second switch connected between the output terminal and a ground terminal in the IC, a third switch having a terminal connected to the output terminal and another terminal connected to a first charge collecting terminal, a fourth switch having a terminal connected to the output terminal and another terminal connected to a second charge collecting terminal, the data voltage input terminal of the IC to drive the column electrodes being connected to a data voltage source, a first charge collecting terminal being connected to an anode of a first diode having another terminal connected to the data voltage source, a cathode of a second diode having another terminal grounded, and a cathode of a third diode having another terminal connected to a charge collecting coil, and the second charge collecting terminal connected to an anode of a fourth diode having another terminal connected to the data voltage source, a cathode of a fifth diode having another terminal grounded, and the charge collecting coil having another terminal connected to the anode of the fourth diode.

* * * * *